US012759742B2

(12) United States Patent
Ishiguro et al.

(10) Patent No.: US 12,759,742 B2
(45) Date of Patent: Oct. 13, 2026

(54) BINDING MACHINE

(71) Applicant: Max Co., Ltd., Tokyo (JP)

(72) Inventors: Hiroki Ishiguro, Tokyo (JP); Taichi Yamazaki, Tokyo (JP); Shigeki Shindou, Tokyo (JP)

(73) Assignee: Max Co., Ltd., Tokyo (JP)

( * ) Notice: Subject to any disclaimer, the term of this patent is extended or adjusted under 35 U.S.C. 154(b) by 266 days.

(21) Appl. No.: 18/494,394

(22) Filed: Oct. 25, 2023

(65) Prior Publication Data

US 2024/0140635 A1 May 2, 2024

(30) Foreign Application Priority Data

Oct. 26, 2022 (JP) ..... 2022-171063

(51) Int. Cl.

| | |
|---|---|
| ***B65B 13/02*** | (2006.01) |
| ***B65B 13/18*** | (2006.01) |
| ***B65B 13/28*** | (2006.01) |
| ***E04G 21/12*** | (2006.01) |

(52) U.S. Cl.

CPC ..... *B65B 13/02* (2013.01); *B65B 13/185* (2013.01); *B65B 13/28* (2013.01); *E04G 21/123* (2013.01)

(58) Field of Classification Search

CPC ..... B21F 15/00; B21F 15/02; B21F 15/04; B21F 7/00; B65B 13/22; B65B 13/28; B65B 13/285; B65B 13/025; B65B 13/04; B65B 13/06; B65B 27/10; B25B 25/00; E04G 21/123; E04G 21/122

See application file for complete search history.

(56) References Cited

U.S. PATENT DOCUMENTS 5,983,473 A * 11/1999 Yuguchi ..... E04G 21/123 29/33 F
2018/0148943 A1 5/2018 Itagaki et al.
2018/0161848 A1 6/2018 Itagaki et al.
2018/0207709 A1 7/2018 Kasahara et al.
(Continued)

FOREIGN PATENT DOCUMENTS

EP 3326921 A1 5/2018
JP H07-040411 A 2/1995
(Continued)

OTHER PUBLICATIONS

Translation of WO-2017014268.*
(Continued)

*Primary Examiner* — Bobby Yeonjin Kim
(74) *Attorney, Agent, or Firm* — Banner & Witcoff, Ltd.

(57) ABSTRACT

A binding machine includes: a wire feeding portion configured to feed a plurality of wires; a curl forming portion configured to constitute a looped feeding path for winding the plurality of wires fed by the wire feeding portion around a binding object; and a binding portion configured to twist the plurality of wires wound around the binding object. The curl forming portion includes: a curl guide configured to curl the plurality of wires fed by the wire feeding portion; and a leading guide configured to lead the plurality of wires curled by the curl guide to the binding portion. The curl guide is configured to allow the plurality of wires to pass therethrough while being arranged in a radial direction of the looped feeding path.

10 Claims, 26 Drawing Sheets

(56) References Cited

U.S. PATENT DOCUMENTS

| | | | |
|---|---|---|---|
| 2020/0290109 | A1 | 9/2020 | Yoshida et al. |
| 2020/0378140 | A1 | 12/2020 | Itagaki et al. |
| 2021/0114080 | A1 | 4/2021 | Itagaki et al. |
| 2021/0138527 | A1 | 5/2021 | Itagaki et al. |
| 2022/0220755 | A1 | 7/2022 | Itagaki et al. |
| 2023/0166319 | A1 | 6/2023 | Yoshida et al. |

FOREIGN PATENT DOCUMENTS

| | | | | | |
|---|---|---|---|---|---|
| JP | 3010353 | B1 | | 2/2000 | |
| JP | 2004-332494 | A | | 11/2004 | |
| JP | 2010112107 | A | | 5/2010 | |
| JP | 2020147298 | A | | 9/2020 | |
| JP | 6791141 | B2 | | 11/2020 | |
| RU | 2689108 | C1 | | 5/2019 | |
| WO | 2007141822 | A1 | | 12/2007 | |
| WO | WO-2017014268 | A1 | * | 1/2017 | ..... B65B 27/10 |
| WO | WO-2017014276 | A1 | * | 1/2017 | ..... B65B 13/22 |

OTHER PUBLICATIONS

Translation of WO-2017014276.*
Mar. 26, 2024—(EP) Extended Search Report—EP App. 23204855.3.
Aug. 13, 2026—(RU) Official Action—RU App 2023127414.

* cited by examiner

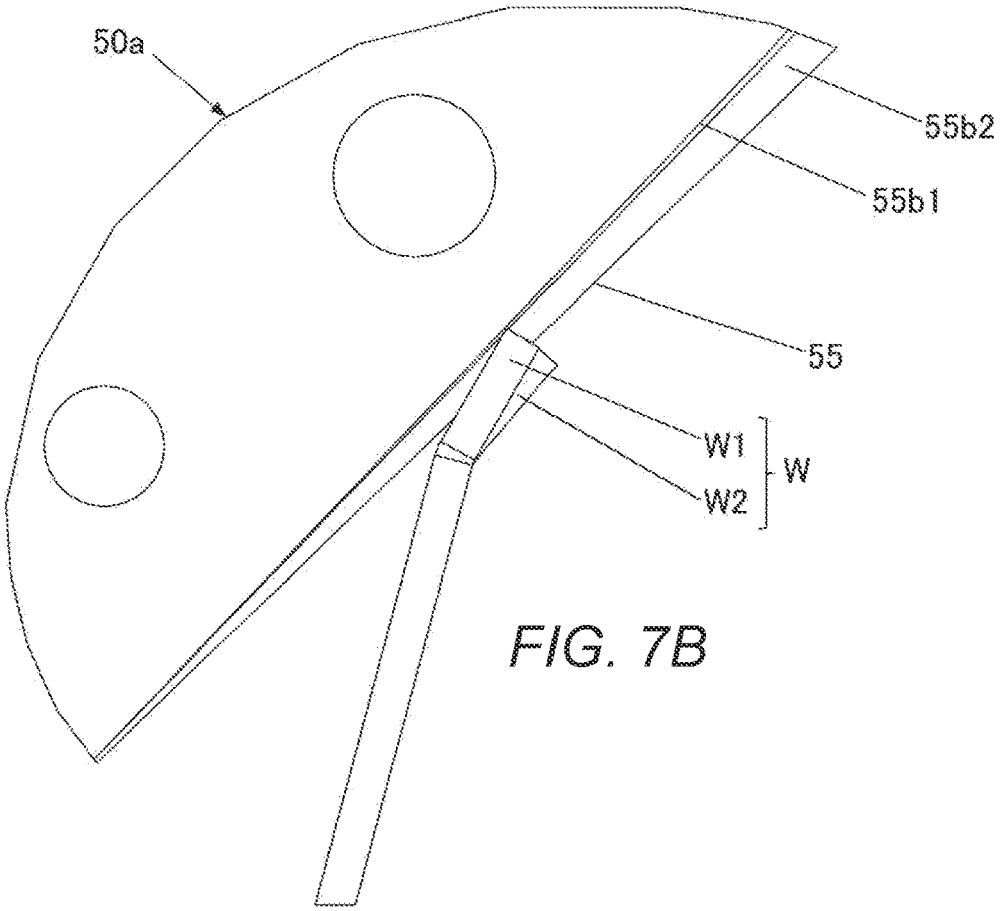
FIG. 7B
FIG. 7C
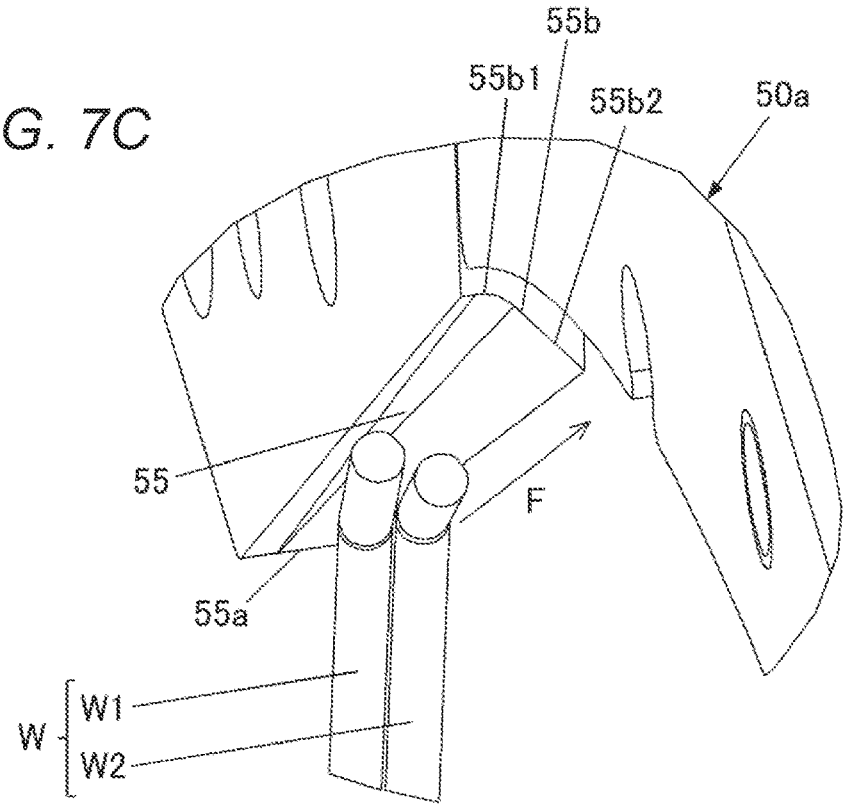

BINDING MACHINE

CROSS-REFERENCE TO RELATED APPLICATIONS

This application is based on Japanese Patent Application No. 2022-171063 filed on Oct. 26, 2022, the contents of which are incorporated herein by way of reference.

TECHNICAL FIELD

The present disclosure relates to a binding machine for binding a binding object such as a reinforcing bar with a wire.

BACKGROUND ART

Reinforcing bars are used for a concrete structure in order to improve strength, and the reinforcing bars are bound by a wire such that the reinforcing bars do not deviate from a predetermined position during concrete placement.

In the related art, there has been proposed a binding machine referred to as a reinforcing bar binding machine that winds a wire around two or more reinforcing bars and twists the wire wound around the reinforcing bars to bind the two or more reinforcing bars with the wire.

When reinforcing bars are bound with a wire, if the binding becomes loose, the reinforcing bars are displaced from each other, and thus, it is required to firmly hold the reinforcing bars together. By using a wire with a large diameter, it is possible to ensure strength of binding reinforcing bars. However, if a wire with a large diameter is used, rigidity of the wire increases, and thus, a large force is required to bind reinforcing bars.

Here, there has been proposed a binding machine including a feeding portion configured to feed two or more wires and wind the two or more wires around a binding object, and a binding portion configured to bind the binding object by gripping and twisting the two or more wires wound around the binding object by the feeding portion, in which the feeding portion feeds the two or more wires in parallel in an axial direction of a looped feeding path for the wires (for example, see Patent Literature 1).

Patent Literature 1: JP6791141B

As a diameter of reinforcing bars to be bound increases, it is necessary to increase a diameter of a feeding path for a wire that is wound in a looped shape around the reinforcing bars. However, when the diameter of the looped feeding path for the wire increases, in the feeding path for a plurality of wires fed from a curl guide by wire feeding performed by a wire feeding portion, positions of the wires along an axial direction of the looped feeding path vary.

This variation increases as the diameter of the looped feeding path increases. In a configuration in which a plurality of wires are arranged in parallel along an axial direction of a looped feeding path, within a curl guide, each wire has a greater amount of movement along the axial direction of the looped feeding path. Therefore, there is a possibility that the wire does not enter a leading guide. In this regard, if a size of the leading guide is increased such that the wire can enter the leading guide, a size and a weight of a binding machine are increased, which may deteriorate operability.

The present disclosure is made to solve such a problem, and an example of the object thereof is to provide a binding machine in which in a feeding path for a plurality of wires fed from a curl guide by wire feeding performed by a wire feeding portion, positions of the wires along an axial direction of a looped feeding path is stabilized.

SUMMARY OF INVENTION

In order to solve the above problem, the present disclosure relates to a binding machine including: a wire feeding portion configured to feed a plurality of wires; a curl forming portion configured to constitute a looped feeding path for winding the plurality of wires fed by the wire feeding portion around a binding object; and a binding portion configured to twist the plurality of wires wound around the binding object, in which the curl forming portion includes: a curl guide configured to curl the plurality of wires fed by the wire feeding portion; and a leading guide configured to lead the plurality of wires curled by the curl guide to the binding portion, and the curl guide is configured to allow the plurality of wires to pass therethrough while being arranged in a radial direction of the looped feeding path.

In addition, the present disclosure relates to a binding machine including: a wire feeding portion configured to feed a plurality of wires; a curl forming portion configured to constitute a looped feeding path for winding the plurality of wires fed by the wire feeding portion around a binding object; and a binding portion configured to twist the plurality of wires wound around the binding object, in which the curl forming portion includes: a curl guide configured to curl the plurality of wires fed by the wire feeding portion; and a leading guide configured to lead the plurality of wires curled by the curl guide to the binding portion, and the curl guide includes a parallel guide portion with a width longer than a diameter of each wire and shorter than twice the diameter of each wire at a downstream side with respect to a feeding direction of the wires that are fed in a direction where the wires are wound around the binding object.

In the present disclosure, the plurality of wires that are curled by the curl guide pass through the curl guide while being arranged in the radial direction of the looped feeding path, and are fed to the leading guide.

BRIEF DESCRIPTION OF DRAWINGS

FIG. 7B is an enlarged side view of the main part, which shows an example of the operation of leading the orientation where the wires are arranged in parallel in the curl guide.

FIG. 7C is an enlarged perspective view of the main part, which shows an example of the operation of leading the orientation where the wires are arranged in parallel in the curl guide.

DESCRIPTION OF EMBODIMENTS

Hereinafter, an example of a reinforcing bar binding machine as an embodiment of a binding machine according to the present disclosure will be described below with reference to the drawings.

Figure 1A:
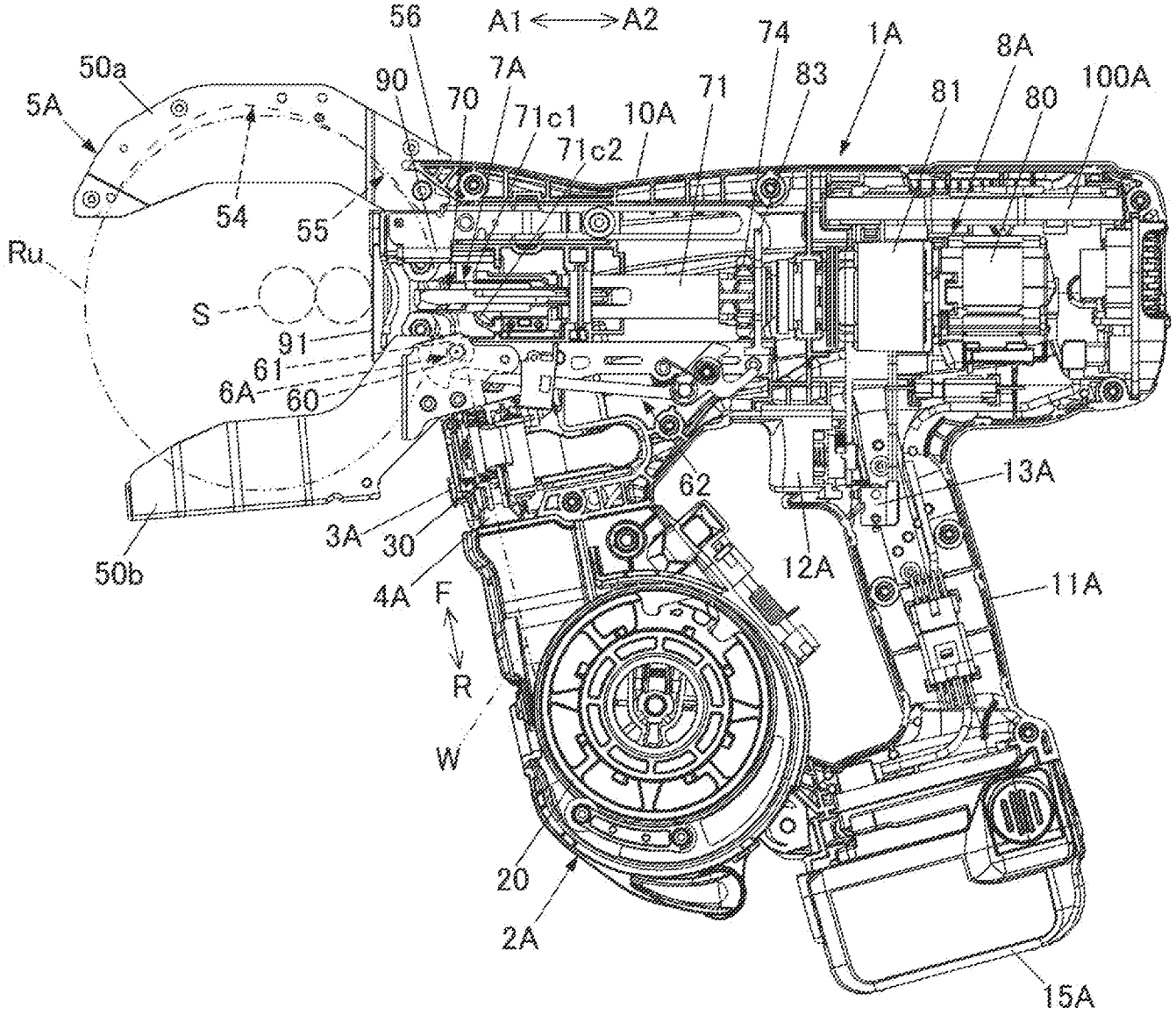
FIG. 1A is an internal configuration diagram seen from a side, which shows an example of an overall configuration of a reinforcing bar binding machine according to a first embodiment.
Figure 1B:
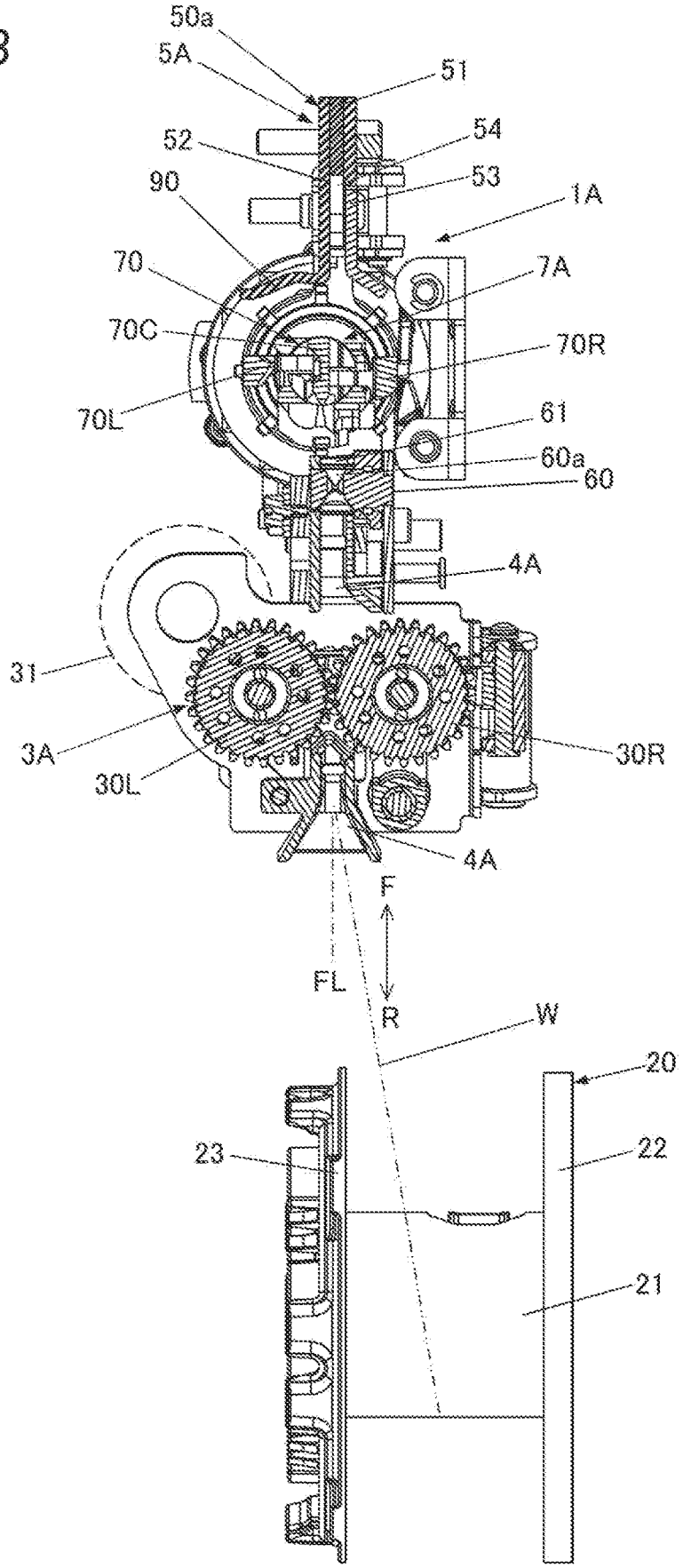
FIG. 1B is an internal configuration diagram seen from a front, which shows the example of the overall configuration of the reinforcing bar binding machine according to the first embodiment.
Figure 1C:
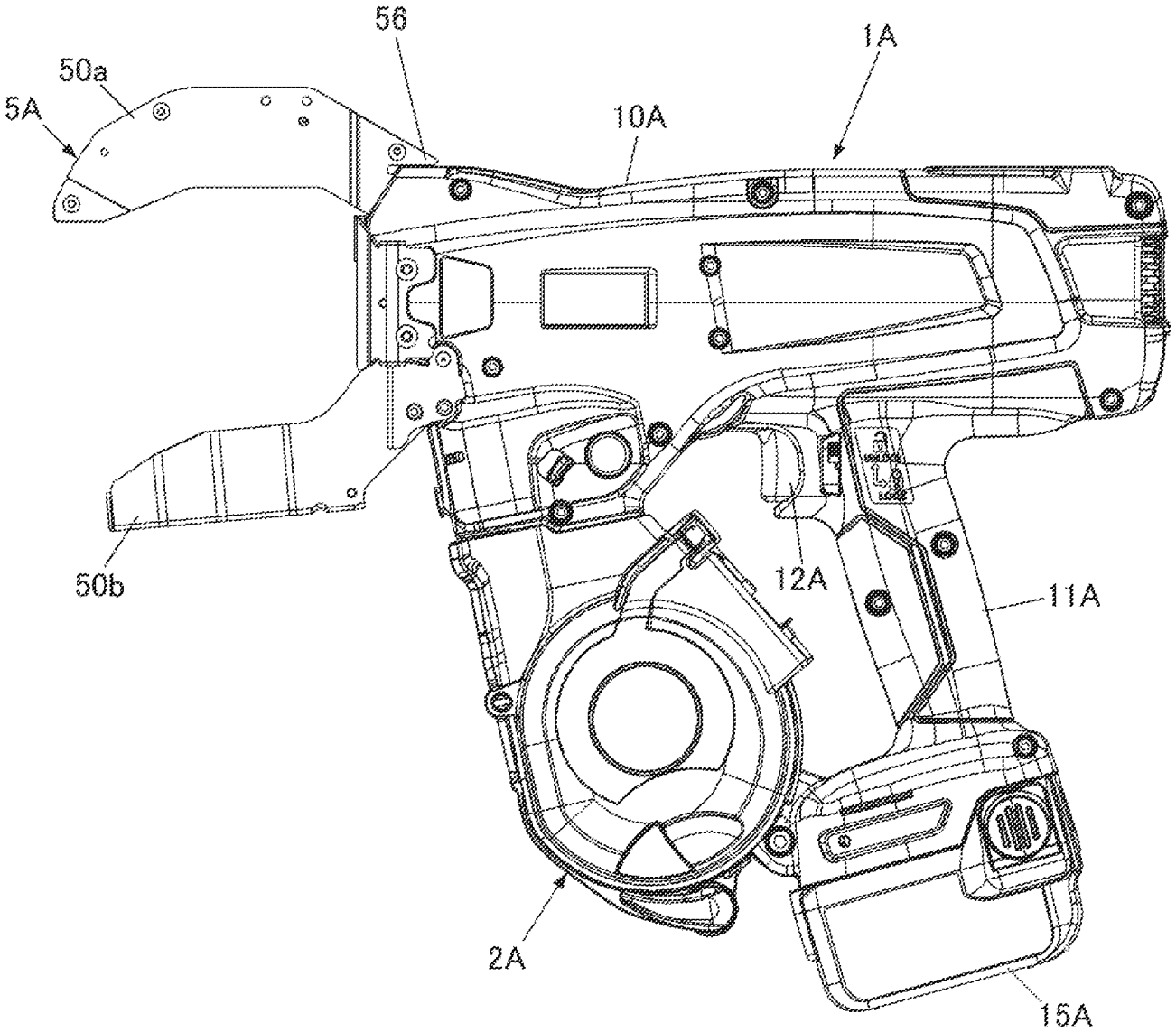
FIG. 1C is a side view which shows the example of the overall configuration of the reinforcing bar binding machine according to the first embodiment.

Configuration Example of Reinforcing Bar Binding Machine According to First Embodiment FIG. 1A is an internal configuration diagram seen from a side, which shows an example of an overall configuration of a reinforcing bar binding machine according to a first embodiment, FIG. 1B is an internal configuration diagram seen from a front, which shows the example of the overall configuration of the reinforcing bar binding machine according to the first embodiment, and FIG. 1C is a side view which shows the example of the overall configuration of the reinforcing bar binding machine according to the first embodiment.

A reinforcing bar binding machine 1A is held in a hand of an operator for use, and includes a main body portion 10A and a handle portion 11A. The reinforcing bar binding machine 1A feeds a wire W in a forward direction indicated by an arrow F, winds the wire W around reinforcing bars S serving as binding objects, feeds the wire W wound around the reinforcing bars S in a reverse direction indicated by an arrow R, winds the wire W around the reinforcing bars S, and then twists the wire W to bind the reinforcing bars S with the wire W. The reinforcing bar binding machine 1A binds the reinforcing bars S with a plurality of wires W, two wires W in the present embodiment.

In order to implement the above functions, the reinforcing bar binding machine 1A includes a magazine 2A in which the wires W are accommodated, a wire feeding portion 3A that feeds two wires W while being arranged in a radial direction of the wires W, and wire guides 4A that guide the two wires W fed to the wire feeding portion 3A. The reinforcing bar binding machine 1A includes a curl forming portion 5A that constitutes a looped feeding path for winding the two wires W fed by the wire feeding portion 3A around the reinforcing bars S, and a cutting portion 6A that cuts the two wires W wound around the reinforcing bars S. Further, the reinforcing bar binding machine 1A includes a binding portion 7A that twists the two wires W wound around the reinforcing bars S, and a drive portion 8A that drives the binding portion 7A.

The magazine 2A is an example of an accommodation portion, and rotatably and detachably accommodates a reel 20 on which the long wire W is wound in a manner of being able to be fed out. As the wire W, a wire made of a metal wire capable of being plastically deformed, a wire obtained by coating a metal wire with a resin, or a stranded wire may be used.

The reel 20 includes a tubular hub portion 21 around which the wire W is wound, and a pair of flange portions 22 and 23 integrally provided on both end sides in an axial direction of the hub portion 21. The flange portions 22 and 23 each have a substantially disk-like shape with a larger diameter than the hub portion 21 and are provided concentrically with the hub portion 21. The reel 20 is implemented in a manner that the two wires W are wound around the hub portion 21, and the two wires W are capable of being drawn out from the reel at the same time.

As shown in FIG. 1B, in the reinforcing bar binding machine 1A, the reel 20 is attached while being offset in one direction along an axial direction of the reel 20 along the axial direction of the hub portion 21 with respect to a feeding path FL for the wires W, which is defined by the wire feeding portion 3A, the wire guides 4A, and the like.

The wire feeding portion 3A includes a pair of feeding gears 30 (30L and 30R) that sandwich and feed the two wires W arranged in parallel. In the wire feeding portion 3A, a rotational operation of a feeding motor 31 is transmitted to one feeding gear 30L. The rotational operation of the one feeding gear 30L is transmitted to another feeding gear 30R by meshing of gear portions provided on outer peripheries of the feeding gear 30L and the feeding gear 30R. Accordingly, the one feeding gear 30L becomes a drive side, and the other feeding gear 30R becomes a driven side.

The wire feeding portion 3A arranges the two wires W in parallel along a direction where the pair of feeding gears 30L and 30R are arranged. In the wire feeding portion 3A, one wire W is in contact with a groove of the one feeding gear 30L, the other wire W is in contact with a groove of the other feeding gear 30R, and the one wire W and the other wire W are in contact with each other. Accordingly, by rotation of the pair of feeding gears 30 (30L and 30R), the wire feeding portion 3A feeds, along an extending direction of the wires W, the two wires W sandwiched between the pair of feeding gears 30 (30L and 30R) due to a frictional force generated between the one feeding gear 30L and the one wire W, a frictional force generated between the other feeding gear 30R and the other wire W, and a frictional force generated between the two wires W.

The wire feeding portion 3A switches a rotation direction of the feeding gears 30 by switching a rotation direction of the feeding motor 31 between forward and reverse, thereby switching a feeding direction of the wires W between forward and reverse.

The wire guides 4A are disposed on an upstream side and a downstream side of the feeding gears 30 with respect to the feeding direction of the wires W fed in the forward direction. The wire guides 4A guide the incoming two wires W between the pair of feeding gears 30 while arranging the wires in parallel along the direction where the pair of feeding gears 30 are arranged.

The wire guides 4A are configured such that an opening on the upstream side with respect to the feeding direction of the wires W fed in the forward direction is configured to have a larger opening area than an opening on the downstream side, and part or all of an inner surface of the opening is tapered. Accordingly, an operation of inserting the wires W drawn out from the reel 20 accommodated in the magazine 2A into the wire guides 4A can be easily performed.

The curl forming portion 5A includes a curl guide 50*a* that curls the two wires W fed by the wire feeding portion 3A and regulates an orientation where the two wires W are arranged in parallel, and a leading guide 50*b* that leads the two wires W curled by the curl guide 50*a* to the binding portion 7A. By curling the two wires W fed by the wire feeding portion 3A and passing through the curl guide 50*a*, the curl forming portion 5A forms a looped feeding path Ru from the curl guide 50*a* through the leading guide 50*b* to reach the binding portion 7A as indicated by a chain double-dashed line in FIGS. 1A to 1C. The curl guide 50*a* passes the two wires W while being arranged in a radial direction of the looped feeding path Ru. The curl guide 50*a* leads the two wires W so as to be oriented to be arranged in the radial direction of the looped feeding path Ru.

The cutting portion 6A includes a fixed blade portion 60, a movable blade portion 61 that cuts the wire Win cooperation with the fixed blade portion 60, and a transmission mechanism 62 that transmits an operation of the binding portion 7A to the movable blade portion 61. The cutting portion 6A cuts the wire W by a rotational operation of the movable blade portion 61 with the fixed blade portion 60 as a fulcrum shaft. The cutting portion 6A performs an operation of cutting the two wires W, and leads the two wires W so as to be oriented to be arranged in the radial direction of the looped feeding path Ru.

The binding portion 7A includes a wire locking body 70 in which the wire W is locked, and a sleeve 71 that actuates the wire locking body 70. The drive portion 8A includes a motor 80 and a speed reducer 81 that performs deceleration and torque amplification.

The reinforcing bar binding machine 1A includes a feeding regulation portion 90 against which a distal end of the wire W abuts at an end of the feeding path for the wire W that passes through the looped feeding path Ru and is locked by the wire locking body 70. In the reinforcing bar binding machine 1A, the curl guide 50*a* and the leading guide 50*b* of the curl forming portion 5A described above are provided at a front end of the main body portion 10A. Further, in the reinforcing bar binding machine 1A, an abutting portion 91 against which the reinforcing bars S are abutted is provided between the curl guide 50*a* and the leading guide 50*b* at the front end of the main body portion 10A. In the reinforcing bar binding machine 1A, the curl guide 50*a* is provided with a convex portion 56 for receiving a force applied to the curl guide 50*a* by the main body portion 10A. The convex portion 56 is provided on a main body portion 10A side of the curl guide 50*a*, protrudes in a direction of the main body portion 10A, and is configured to come into contact with the main body portion 10A.

The handle portion 11A of the reinforcing bar binding machine 1A extends downward from the main body portion 10A. Further, a battery 15A is detachably attached to a lower portion of the handle portion 11A. The reinforcing bar binding machine 1A is provided with the magazine 2A in front of the handle portion 11A. In the reinforcing bar binding machine 1A, the wire feeding portion 3A, the cutting portion 6A, the binding portion 7A, the drive portion 8A for driving the binding portion 7A, and the like described above are accommodated in the main body portion 10A.

The reinforcing bar binding machine 1A is provided with a trigger 12A on a front side of the handle portion 11A and a switch 13A inside the handle portion 11A. In the reinforcing bar binding machine 1A, a controller 100A controls the feeding motor 31 and the motor 80 according to a state of the switch 13A pressed by operating the trigger 12A.

Configuration Example of Main Part of Reinforcing Bar Binding Machine According to Present Embodiment

Configuration Example of Curl Guide

Figure 2A:
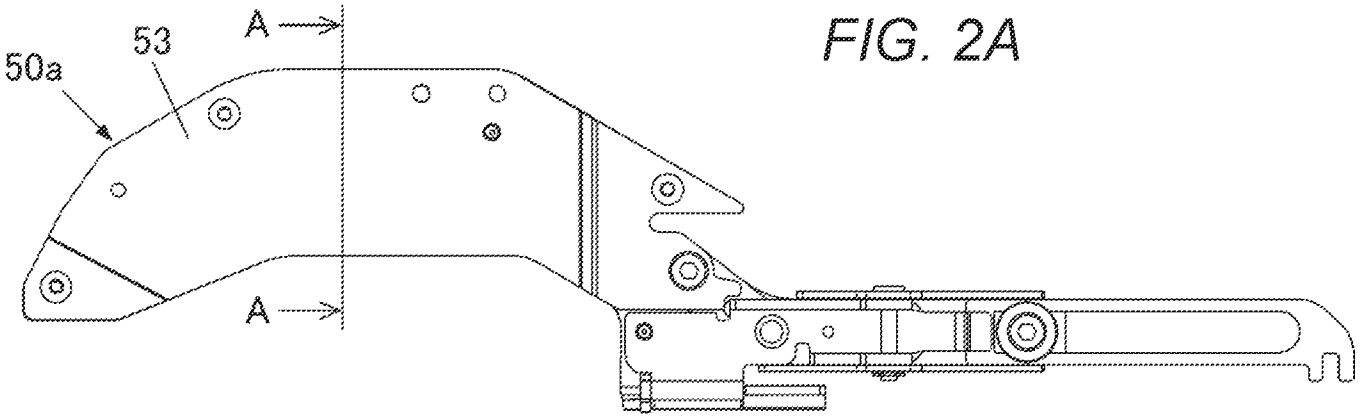
FIG. 2A is a side view which shows an example of a curl guide.
Figure 2B:
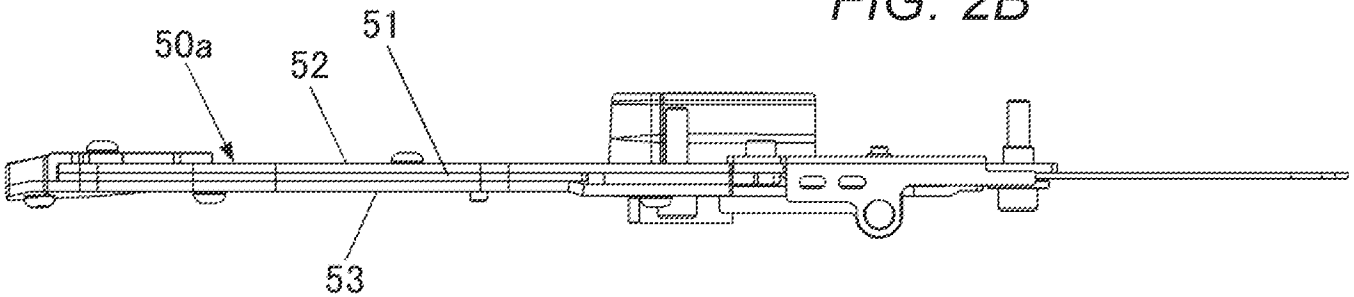
FIG. 2B is a top view which shows the example of the curl guide.
Figure 2C:
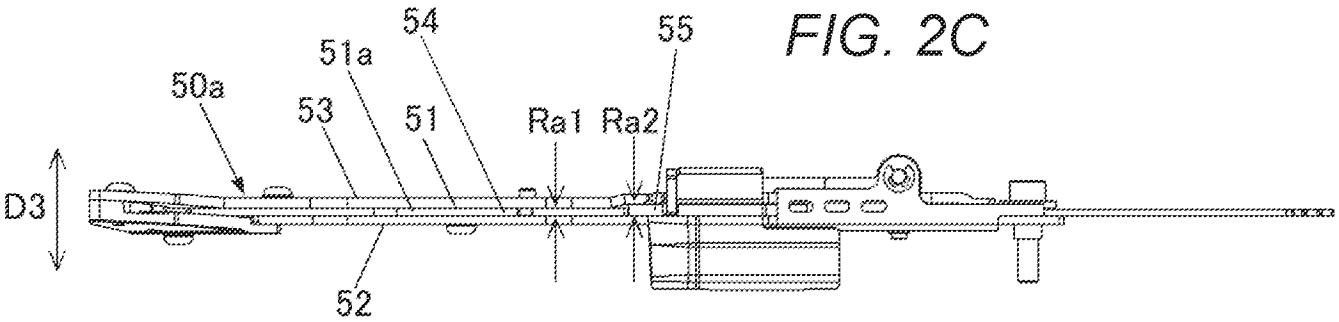
FIG. 2C is a bottom view which shows the example of the curl guide.
Figure 2D:
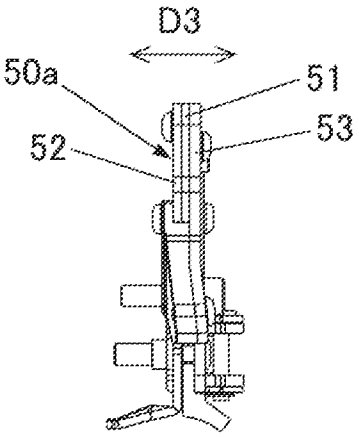
FIG. 2D is a front view which shows the example of the curl guide.
Figure 2E:
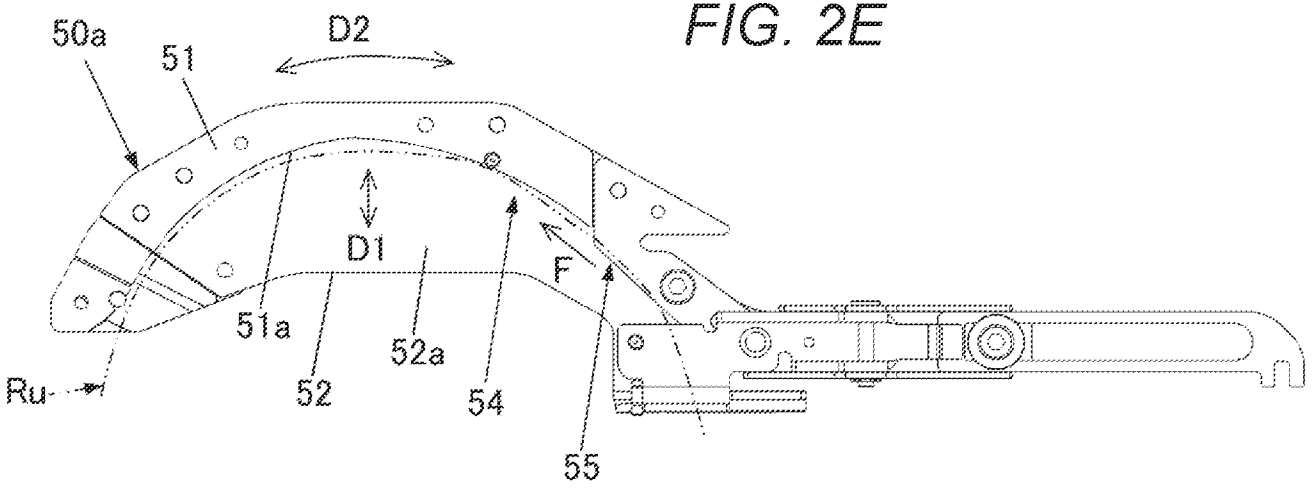
FIG. 2E is a side view which shows an example of a state where some parts of the curl guide are removed.
Figure 2F:
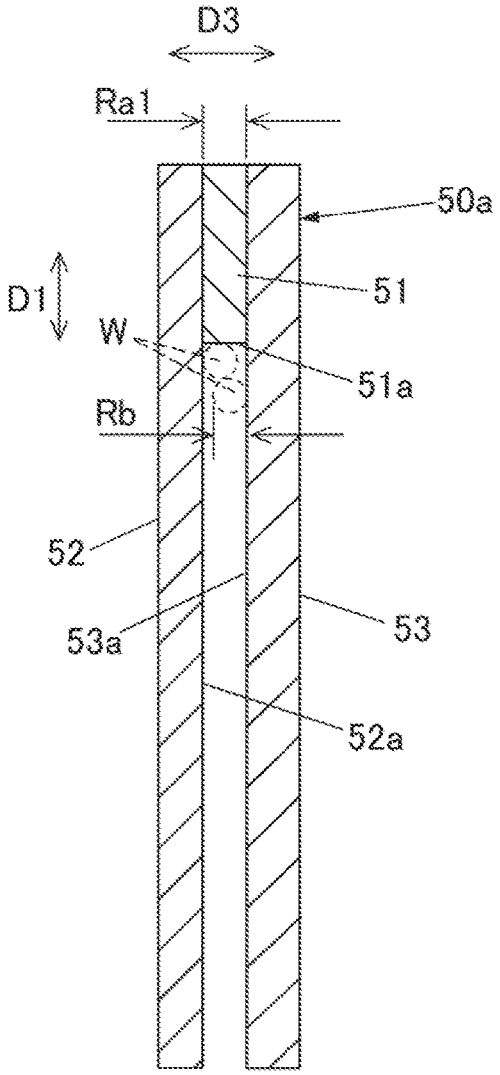
FIG. 2F is a front cross-sectional view which shows the example of the curl guide.
Figure 2G:
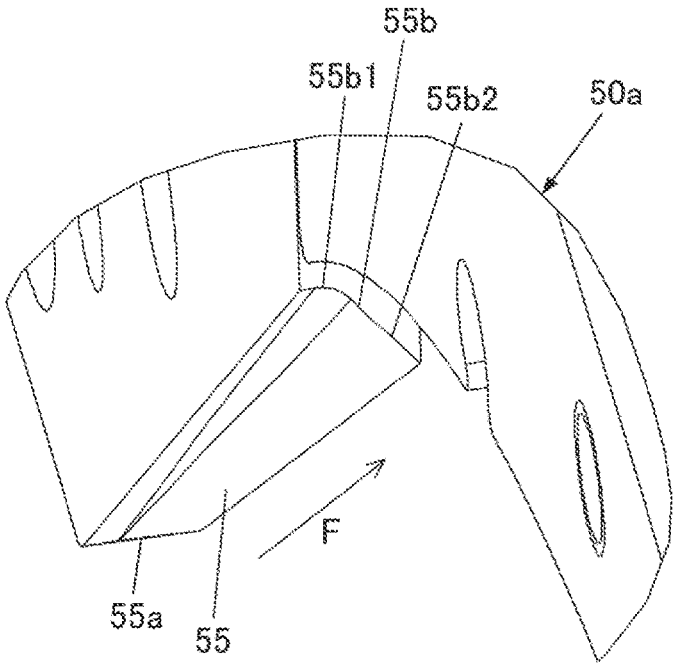
FIG. 2G is a perspective view of a main part, which shows an example of a parallel orientation leading portion of the curl guide.

FIG. 2A is a side view which shows an example of the curl guide, FIG. 2B is a top view which shows the example of the curl guide, FIG. 2C is a bottom view which shows the example of the curl guide, and FIG. 2D is a front view which shows the example of the curl guide. FIG. 2E is a side view which shows an example of a state where some parts of the curl guide are removed. FIG. 2F is a front cross-sectional view which shows the example of the curl guide, and FIG. 2G is a perspective view of a main part, which shows an example of a parallel orientation leading portion of the curl guide. Here, FIG. 2F is a cross-sectional view taken along a line A-A of FIG. 2A. Next, an example of the curl guide 50*a* will be described with reference to the drawings.

The curl guide 50*a* includes a first wire guide 51 that regulates a position of the wire W toward an outer peripheral side in the radial direction along a circumferential direction of the looped feeding path Ru indicated by an arrow D2 with respect to the radial direction of the looped feeding path Ru indicated by an arrow D1 in FIG. 2E and FIG. 2F.

The curl guide 50*a* includes a second wire guide 52 that regulates the position of the wire W toward one side in the axial direction along the circumferential direction of the looped feeding path Ru indicated by the arrow D2 with respect to the axial direction of the looped feeding path Ru indicated by an arrow D3 in FIG. 2C, FIG. 2D, FIG. 2F, and the like.

The curl guide 50*a* further includes a third wire guide 53 that regulates the position of the wire W toward the other side in the axial direction along the circumferential direction of the looped feeding path Ru indicated by the arrow D2 with respect to the axial direction of the looped feeding path Ru indicated by the arrow D3.

The first wire guide 51 has a first guide surface 51*a* implemented by a concave curved surface along the looped feeding path Ru or the like.

The second wire guide 52 has a shape with a portion in contact with one side surface of the first wire guide 51 along the axial direction of the looped feeding path Ru and a portion protruding inward along the radial direction of the looped feeding path Ru from the first guide surface 51*a* of the first wire guide 51. The second wire guide 52 has a second guide surface 52*a* at a portion protruding inward along the radial direction of the looped feeding path Ru from the first guide surface 51*a* of the first wire guide 51.

The third wire guide 53 has a shape with a portion in contact with the other side surface of the first wire guide 51 along the axial direction of the looped feeding path Ru and a portion protruding inward along the radial direction of the looped feeding path Ru from the first guide surface 51*a* of the first wire guide 51. The third wire guide 53 has a third guide surface 53*a* at a portion protruding inward along the radial direction of the looped feeding path Ru from the first guide surface 51*a* of the first wire guide 51.

In the curl guide 50*a*, the first wire guide 51 is sandwiched between the second wire guide 52 and the third wire guide 53, and the second guide surface 52*a* of the second wire guide 52 and the third guide surface 53*a* of the third wire guide 53 face each other with a gap corresponding to a thickness of the first wire guide 51 therebetween.

The curl guide 50*a* includes a parallel guide portion 54 for allowing the two wires W to pass through while being arranged in the radial direction of the looped feeding path Ru indicated by the arrow D1. The curl guide 50*a* includes a parallel orientation leading portion 55 that leads the two wires W passing through the parallel guide portion 54 so as to be oriented to be arranged in the radial direction of the looped feeding path Ru.

The parallel orientation leading portion 55 leads the two wires passing through the curl guide 50*a* so as to be oriented to be arranged in the radial direction of the looped feeding path Ru on a downstream side of the magazine 2A with respect to the feeding direction of the wires W fed in the forward direction indicated by the arrow F. Therefore, the curl guide 50*a* is provided with the parallel orientation leading portion 55 on the upstream side and the parallel guide portion 54 on the downstream side with respect to the feeding direction of the wires W fed in the forward direction indicated by the arrow F. The parallel orientation leading portion 55 is provided on a downstream side of the wire feeding portion 3A, preferably a downstream side of the wire locking body 70, with respect to the feeding direction of the wires W fed in the forward direction indicated by the arrow F.

In the parallel guide portion 54, the second guide surface 52*a* of the second wire guide 52 and the third guide surface 53*a* of the third wire guide 53 face each other on both sides along the axial direction of the looped feeding path Ru, and between the second guide surface 52*a* and the third guide surface 53*a*, the outer peripheral side along the radial direction of the looped feeding path Ru is implemented by the groove closed by the first guide surface 51*a* of the first wire guide 51.

The curl guide 50*a* is configured such that at the portion where the parallel guide portion 54 is provided, a gap (width) Ra1 between the second guide surface 52*a* of the second wire guide 52 and the third guide surface 53*a* of the third wire guide 53 is longer than a diameter Rb of the wire W and shorter than twice the diameter Rb of the wire W. Accordingly, the curl guide 50*a* allows the two wires W fed by the wire feeding portion 3A to pass through while being arranged in the radial direction of the looped feeding path Ru by regulation by the gap Ra1 between the second guide surface 52*a* and the third guide surface 53*a* of the parallel guide portion 54. The gap Ra1 in the parallel guide portion 54 is preferably 1.5 times or less the diameter Rb of the wire W such that the direction where the two wires W are arranged in parallel is 45 degrees or less with respect to the radial direction of the looped feeding path Ru.

The parallel orientation leading portion 55 is implemented by a surface on the outer peripheral side along the radial direction of the looped feeding path Ru. The curl guide 50*a* is configured such that at the portion where the parallel orientation leading portion 55 is provided, a gap Ra2 between the second guide surface 52*a* of the second wire guide 52 and the third guide surface 53*a* of the third wire guide 53 is longer than twice the diameter Rb of the wire W. Accordingly, in the curl guide 50*a*, the two wires W passing through the parallel orientation leading portion 55 can be arranged in parallel in an orientation crossing the radial direction of the looped feeding path Ru.

The parallel orientation leading portion 55 includes an introduction portion 55*a* on the upstream side with respect to the feeding direction of the wires W fed in the forward direction indicated by the arrow F. The introduction portion 55*a* is provided along the axial direction of the looped feeding path Ru along the orientation where the two wires W fed by the wire feeding portion 3A are arranged in parallel. The parallel orientation leading portion 55 includes a delivery portion 55*b* on the downstream side connected to the parallel guide portion 54. The delivery portion 55*b* is inclined in a predetermined orientation with respect to the radial direction of the looped feeding path Ru in a direction approaching an orientation along the radial direction of the looped feeding path Ru.

In the present example, in the delivery portion 55*b* of the parallel orientation leading portion 55, a second leading portion 55*b*2 with which the other wire W is in contact protrudes to an inner peripheral side along the radial direction of the looped feeding path Ru with respect to a first leading portion 55*b*1 with which the one wire W is in contact.

Accordingly, the parallel orientation leading portion 55 is implemented by a surface that is inclined from the introduction portion 55*a* toward the delivery portion 55*b* in a manner of twisting in a direction gradually approaching the orientation along the radial direction of the looped feeding path Ru.

Therefore, in the two wires W fed by the wire feeding portion 3A and passing through the parallel orientation leading portion 55, the curl guide 50*a* leads the other wire W in contact with the second leading portion 55*b*2 to the inner peripheral side along the radial direction of the looped feeding path Ru with respect to the one wire W in contact with the first leading portion 55*b*1. The one wire Win contact with the first leading portion 55*b*1 is in contact with the feeding gear 30L which is the drive side, and the other wire W in contact with the second leading portion 55*b*2 is in contact with the feeding gear 30R which is the driven side.

The curl guide 50*a* allows to pass the two wires W led by the parallel orientation leading portion 55 so as to be oriented to be arranged in the radial direction of the looped feeding path Ru through the parallel guide portion 54, thereby keeping the wires W arranged in the radial direction of the looped feeding path Ru.

Figure 2H:
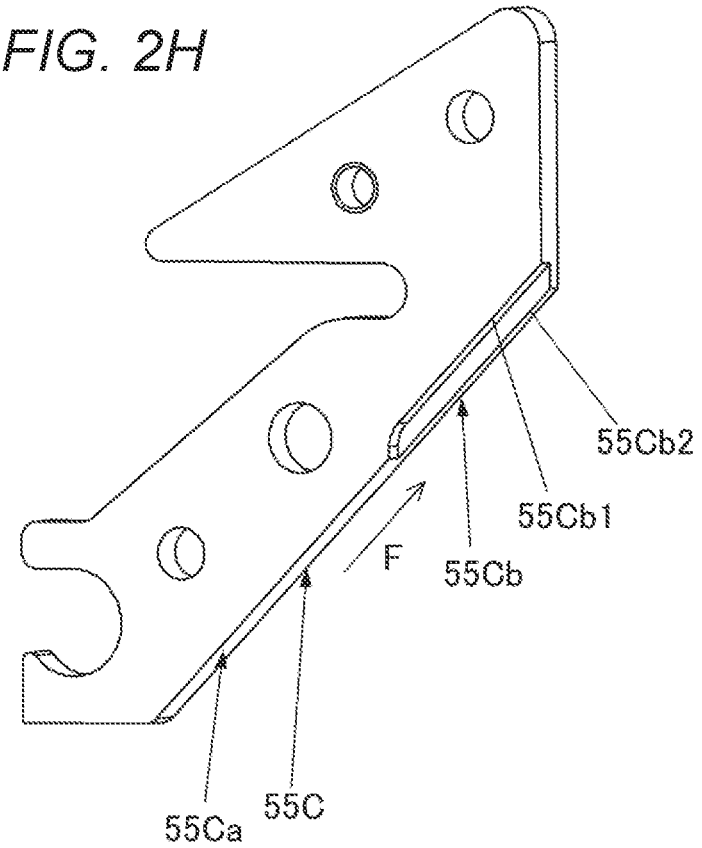
FIG. 2H is a perspective view of the main part, which shows another example of the parallel orientation leading portion of the curl guide.
Figure 2I:
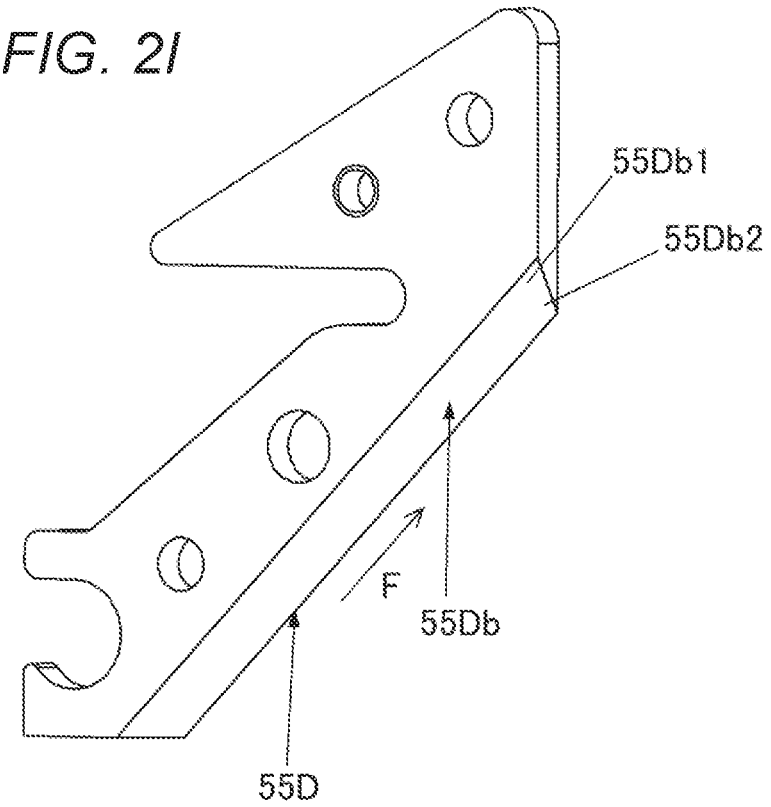
FIG. 2I is a perspective view of the main part, which shows another example of the parallel orientation leading portion of the curl guide.

Each of FIG. 2H and FIG. 2I is a perspective view of the main part, which shows another example of the parallel orientation leading portion of the curl guide. A parallel orientation leading portion 55C shown in FIG. 2H includes an introduction portion 55Ca on the upstream side with respect to the feeding direction of the wires W fed in the forward direction indicated by the arrow F. The introduction portion 55Ca is provided along the axial direction of the looped feeding path Ru along the orientation where the two wires W fed by the wire feeding portion 3A are arranged in parallel. The parallel orientation leading portion 55C includes a delivery portion 55Cb on the downstream side connected to the parallel guide portion 54 shown in FIG. 2E and the like. The delivery portion 55Cb is provided with a step along the radial direction of the looped feeding path Ru, and has a first leading portion 55Cb1 and a second leading portion 55Cb2.

In the present example, in the delivery portion 55Cb of the parallel orientation leading portion 55C, the second leading portion 55Cb2 with which the other wire W is in contact protrudes to the inner peripheral side along the radial direction of the looped feeding path Ru with respect to the first leading portion 55Cb1 with which the one wire W is in contact. In the parallel orientation leading portion 55C, the introduction portion 55Ca is formed from the upstream side to an intermediate position of the parallel orientation leading portion 55C with respect to the feeding direction of the wires W fed in the forward direction indicated by the arrow F, and the first leading portion 55Cb1 and the second leading portion 55Cb2 are formed from the intermediate position of the parallel orientation leading portion 55C.

Therefore, in the two wires W fed by the wire feeding portion 3A, the parallel orientation leading portion 55C leads the other wire W in contact with the second leading portion 55Cb2 to the inner peripheral side along the radial direction of the looped feeding path Ru with respect to the one wire Win contact with the first leading portion 55Cb1.

A parallel orientation leading portion 55D shown in FIG. 2I includes an introduction and delivery portion 55*db* from the upstream side to the downstream side with respect to the feeding direction of the wires W fed in the forward direction indicated by the arrow F. The introduction and delivery portion 55*db* is inclined in a predetermined direction with respect to the radial direction of the looped feeding path Ru in a direction approaching the inner peripheral side along the radial direction of the looped feeding path Ru.

In the present example, the parallel orientation leading portion 55D is formed with the introduction and delivery portion 55*db* over the whole from the upstream side to the downstream side with respect to the feeding direction of the wires W fed in the forward direction indicated by the arrow F. The introduction and delivery portion 55*db* is implemented by an inclined surface in which a second leading portion 55Db2 with which the other wire W is in contact protrudes toward the inner peripheral side along the radial direction of the looped feeding path Ru with respect to a first leading portion 55*db*1 with which the one wire W is in contact.

Therefore, in the two wires W fed by the wire feeding portion 3A, the parallel orientation leading portion 55D leads the other wire W in contact with the second leading portion 55Db2 to the inner peripheral side along the radial direction of the looped feeding path Ru with respect to the one wire Win contact with the first leading portion 55*db*1.

Configuration Example of Cutting Portion

Figure 3:
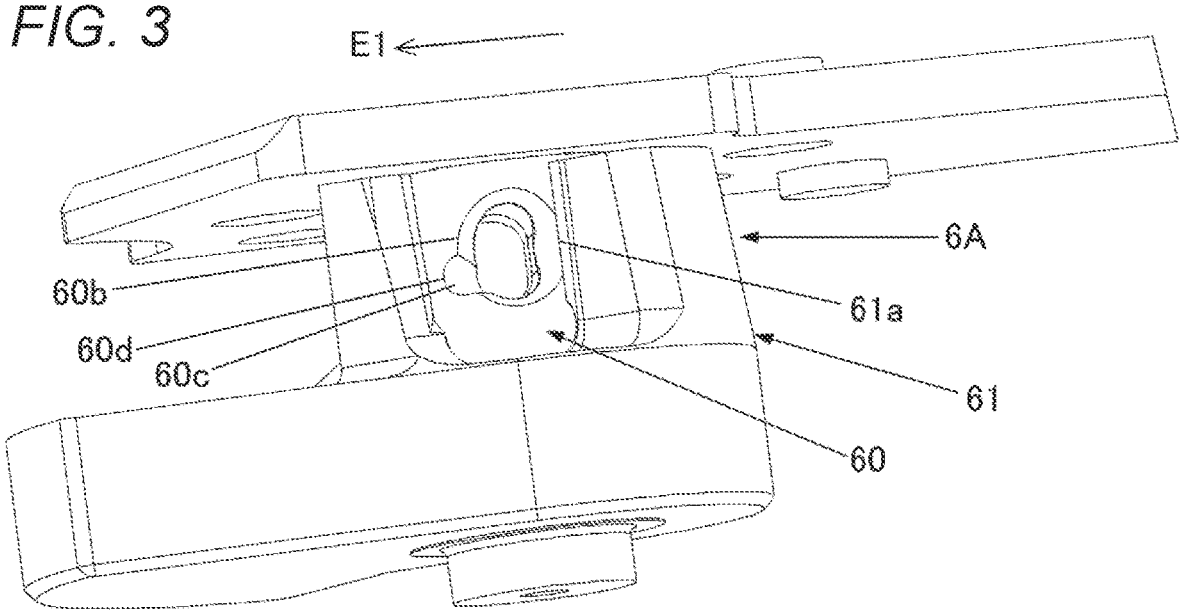
FIG. 3 is a perspective view which shows an example of a cutting portion.

FIG. 3 is a perspective view which shows an example of the cutting portion. Next, an example of the cutting portion 6A will be described with reference to the drawings.

The fixed blade portion 60 is provided on a downstream side of the wire guide 4A with respect to the feeding direction of the wires W fed in the forward direction. The fixed blade portion 60 is implemented by a cylindrical member that serves as a rotation shaft of the movable blade portion 61, and includes a cylindrical opening 60*a* penetrating in the radial direction. The opening 60*a* has an elongated hole shape along the orientation where the two wires W fed by the wire feeding portion 3A are arranged in parallel.

The movable blade portion 61 is supported in a manner of being rotatable about the fixed blade portion 60, and includes a blade portion 61*a* that is in sliding contact with an opening end of the opening 60*a* of the fixed blade portion 60 by a rotational operation with the fixed blade portion 60 as a shaft.

The fixed blade portion 60 includes a first abutting blade portion 60*b* and a second abutting blade portion 60*c* at the opening end of the opening 60*a* with which the blade portion 61*a* of the movable blade portion 61 is in sliding contact. The fixed blade portion 60 is provided with the first abutting blade portion 60*b* and the second abutting blade portion 60*c* along the direction where the two wires W are arranged in parallel.

In the fixed blade portion 60, with respect to a movement direction of the blade portion 61*a* indicated by an arrow E1 due to the rotational operation of the movable blade portion 61 about the fixed blade portion 60, the first abutting blade portion 60*b* is provided on a front side, and the second abutting blade portion 60*c* is provided on a back side. The fixed blade portion 60 is provided with a retraction recess portion 60*d* extending from the opening 60*a* to the second abutting blade portion 60*c*. The retraction recess portion 60*d* is configured such that a recess portion recessed from the opening 60*a* toward the second abutting blade portion 60*c* in a shape to receive one wire W is provided on an inner peripheral surface of the opening 60*a*. In the fixed blade portion 60, an amount by which the second abutting blade portion 60*c* is retracted with respect to the first abutting blade portion 60*b* is preferably about half the diameter of the wire W.

In the cutting portion 6A, the blade portion 61*a* of the movable blade portion 61 comes into sliding contact with the opening end of the opening 60*a* of the fixed blade portion 60 by the rotational operation of the movable blade portion 61 with the fixed blade portion 60 as a shaft. In the cutting portion 6A, when the blade portion 61*a* moves in the direction indicated by the arrow E1 from a standby position with the two wires W passing through the opening 60*a*, the one wire W of the two parallel wires W is pressed against the first abutting blade portion 60*b* by the blade portion 61*a* and is cut by an applied shearing force. The other wire W of the two parallel wires W is pressed by the blade portion 61*a*, bends, enters the retraction recess portion 60*d*, and is then pressed against the second abutting blade portion 60*c* by the blade portion 61*a*, and is cut by the applied shearing force.

Configuration Example of Binding Portion

Figure 4A:
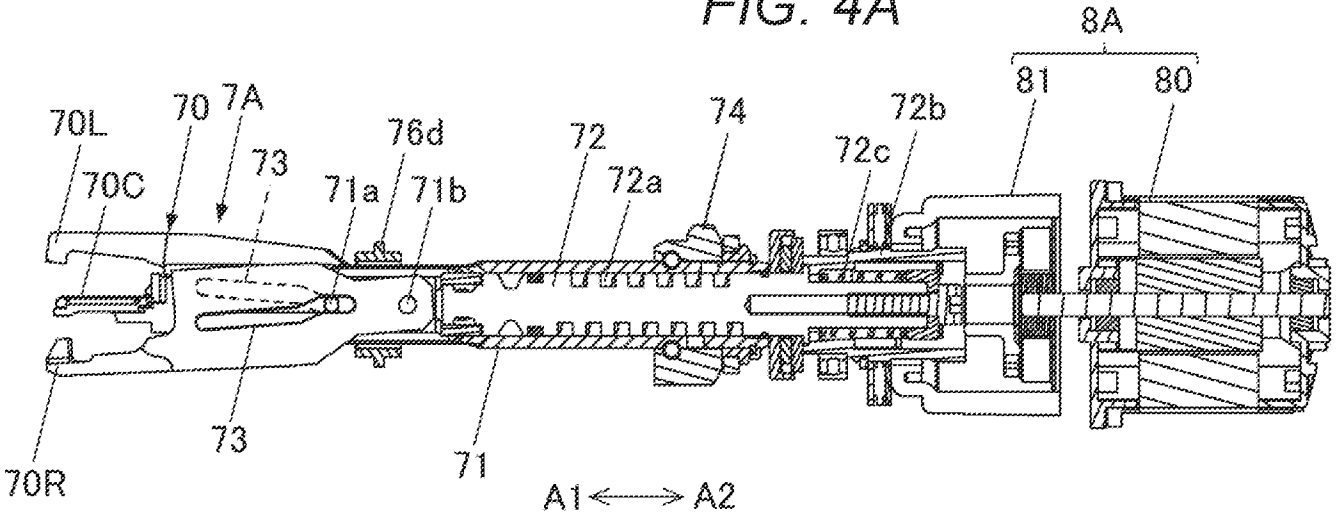
FIG. 4A is a cross-sectional plan view which shows examples of a binding portion and a drive portion.
Figure 4B:
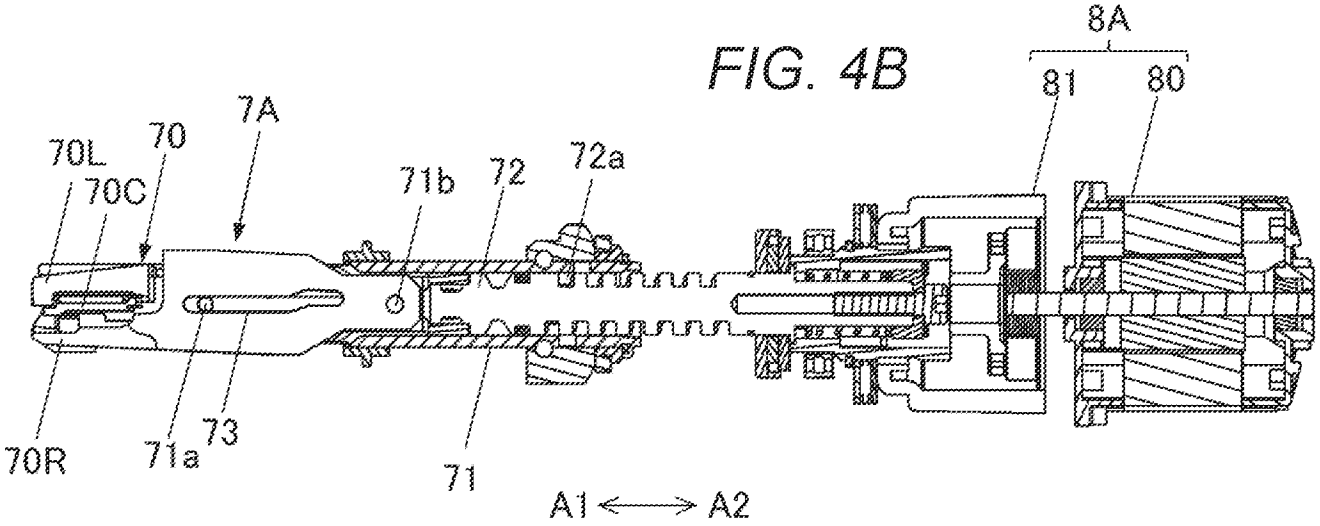
FIG. 4B is a cross-sectional plan view which shows examples of the binding portion and the drive portion.

FIG. 4A and FIG. 4B are cross-sectional plan views which show examples of the binding portion and the drive portion. Next, the configurations of the binding portion 7A and the drive portion 8A will be described with reference to the drawings.

The binding portion 7A includes a rotation shaft 72 that actuates the wire locking body 70 and the sleeve 71. The rotation shaft 72 is connected to the speed reducer 81 via a connection portion 72*b* having a structure that is rotatable integrally with the speed reducer 81 and is movable in an axial direction with respect to the speed reducer 81. The connection portion 72*b* includes a spring 72*c* that biases the rotation shaft 72 rearward in a direction approaching the speed reducer 81 and regulates a position of the rotation shaft 72 along the axial direction. Accordingly, the rotation shaft 72 is configured to move forward, which is a direction away from the speed reducer 81, while receiving a force to be pressed rearward by the spring 72*c*. Therefore, if a force is applied to move the wire locking body 70 forward in the axial direction, the rotation shaft 72 can move forward while receiving the force to be pressed rearward by the spring 72*c*.

The wire locking body 70 includes a center hook 70C coupled to the rotation shaft 72, a first side hook 70R and a second side hook 70L that open and close with respect to the center hook 70C.

The center hook 70C is coupled to a distal end of the rotation shaft 72, which is one end of the rotation shaft 72 in the axial direction, via a configuration capable of rotating with respect to the rotation shaft 72 and capable of moving integrally with the rotation shaft 72 in the axial direction.

In the wire locking body 70, by a rotational operation with a shaft 71*b* as a fulcrum, a distal end side of the first side hook 70R opens and closes in a direction approaching or away from the center hook 70C. A distal end side of the second side hook 70L opens and closes in a direction approaching or away from the center hook 70C.

The sleeve 71 includes a convex portion (not shown) protruding to an inner peripheral surface of a space into which the rotation shaft 72 is inserted, and the convex portion enters a groove of a feeding screw 72*a* formed along the axial direction on an outer periphery of the rotation shaft 72. The sleeve 71 is rotatably supported by the support member 76*d* in a manner of being slidable in the axial direction. When the rotation shaft 72 rotates, the sleeve 71 is moved in a direction along the axial direction of the rotation shaft 72 in accordance with a rotation direction of the rotation shaft 72 due to an action of the convex portion (not shown) and the feeding screw 72*a* of the rotation shaft 72. The sleeve 71 rotates integrally with the rotation shaft 72.

The sleeve 71 includes an opening and closing pin 71*a* that opens and closes the first side hook 70R and the second side hook 70L.

The opening and closing pin 71*a* is inserted into an opening and closing guide hole 73 provided in the first side hook 70R and the second side hook 70L. The opening and closing guide hole 73 extends along the movement direction of the sleeve 71, and has a shape that converts a movement in a linear direction of the opening and closing pin 71*a* moving in conjunction with the sleeve 71 into an opening and closing operation due to rotation of the first side hook 70R and the second side hook 70L with the shaft 71*b* as a fulcrum.

In the wire locking body 70, the sleeve 71 moves in a downward direction indicated by an arrow A2, whereby the first side hook 70R and the second side hook 70L move in a direction away from the center hook 70C by the rotational operation with the shaft 71*b* as a fulcrum due to a trajectory of the opening and closing pin 71*a* and the shape of the opening and closing guide hole 73.

Accordingly, the first side hook 70R and the second side hook 70L are opened with respect to the center hook 70C, and a feeding path through which the wire W passes is respectively formed between the first side hook 70R and the center hook 70C and between the second side hook 70L and the center hook 70C.

In the state where the first side hook 70R and the second side hook 70L are opened with respect to the center hook 70C, the wire W fed by the wire feeding portion 3A passes between the center hook 70C and the first side hook 70R. The wire W that passes between the center hook 70C and the first side hook 70R is led to the curl forming portion 5A. The wire W curled by the curl guide 50*a* and led to the binding portion 7A by the leading guide 50*b* passes between the center hook 70C and the second side hook 70L.

In the wire locking body 70, the sleeve 71 moves in an upward direction indicated by an arrow A1, whereby the first side hook 70R and the second side hook 70L move in the direction approaching the center hook 70C by the rotational operation with the shaft 71*b* as a fulcrum due to the trajectory of the opening and closing pin 71*a* and the shape of the opening and closing guide hole 73. Accordingly, the first side hook 70R and the second side hook 70L are closed with respect to the center hook 70C.

When the first side hook 70R is closed with respect to the center hook 70C, the wire W sandwiched between the first side hook 70R and the center hook 70C is locked in a manner of being movable between the first side hook 70R and the center hook 70C. When the second side hook 70L is closed with respect to the center hook 70C, the wire W sandwiched between the second side hook 70L and the center hook 70C is locked in a manner that the wire W does not come out from a portion between the second side hook 70L and the center hook 70C.

The sleeve 71 includes a bending portion 71*c*1 that forms the wire W into a predetermined shape by pressing and bending a distal end side, which is one end of the wire W, in a predetermined direction, and a bending portion 71*c*2 that forms the wire W into a predetermined shape by pressing and bending a terminal end side, which is the other end of the wire W cut by the cutting portion 6A, in a predetermined direction.

The sleeve 71 moves in the upward direction indicated by the arrow A1, whereby the distal end side of the wire W locked by the center hook 70C and the second side hook 70L is pressed by the bending portion 71*c*1 and bent toward the reinforcing bars S. The sleeve 71 moves in the upward direction indicated by the arrow A1, whereby the terminal end side of the wire W, which is locked by the center hook 70C and the first side hook 70R and cut by the cutting portion 6A, is pressed by the bending portion 71*c*2 and bent toward the reinforcing bars S.

The binding portion 7A includes a rotation regulation portion 74 that regulates the rotations of the wire locking body 70 and the sleeve 71 which are in conjunction with the rotational operation of the rotation shaft 72. In the binding portion 7A, the rotation regulation portion 74 regulates the rotation of the sleeve 71 which is in conjunction with the rotation of the rotation shaft 72 according to a position of the sleeve 71 along the axial direction of the rotation shaft 72, and the sleeve 71 moves in the directions indicated by the arrows A1 and A2 by the rotational operation of the rotation shaft 72.

Accordingly, the sleeve 71 moves in the direction indicated by the arrow A1 without rotating, whereby the first side hook 70R and the second side hook 70L are closed with respect to the center hook 70C, and the wire W is locked. The sleeve 71 moves in the direction indicated by the arrow A2 without rotating, whereby the first side hook 70R and the second side hook 70L are opened with respect to the center hook 70C, and the locking of the wire W is released.

In the binding portion 7A, when the regulation of the rotation of the sleeve 71 by the rotation regulation portion 74 is released, the sleeve 71 rotates in conjunction with the rotation of the rotation shaft 72.

Accordingly, the first side hook 70R and the second side hook 70L, which lock the wire W, and the center hook 70C rotate, and the locked wire W is twisted.

Operation Example of Reinforcing Bar Binding Machine According to First Embodiment FIG. 5A, FIG. 5B, FIG. 5C, and FIG. 5D are perspective views which show an example of the operation of cutting the wire by the cutting portion. Next, the operation of cutting the wires W by the cutting portion 6A in a process of binding the reinforcing bars S with the wires W will be described with reference to the drawings.

Figure 5A:
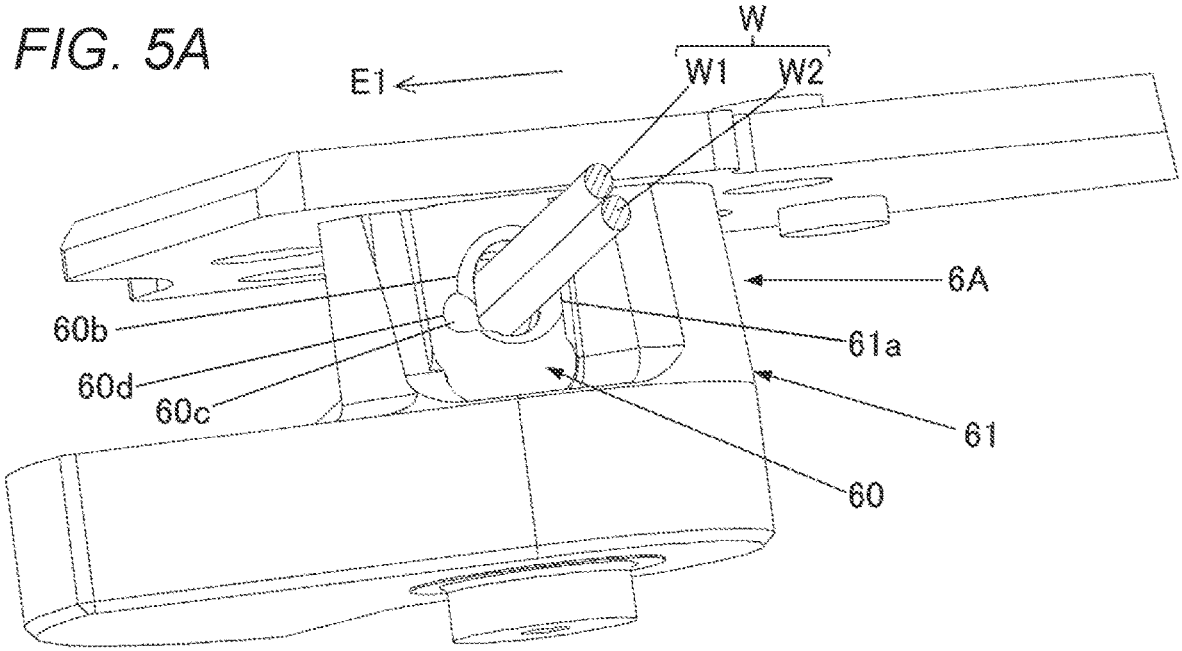
FIG. 5A is a perspective view which shows an example of an operation of cutting wires by the cutting portion.

In the cutting portion 6A, as shown in FIG. 5A, the two wires W fed by the wire feeding portion 3A are passed through the opening 60*a* of the fixed blade portion 60 while the blade portion 61*a* of the movable blade portion 61 is moved to the standby position. The orientation where the two wires W passed through the opening 60*a* are arranged in parallel is the orientation along the axial direction crossing the radial direction of the looped feeding path Ru shown in FIG. 1A and the like.

In the cutting portion 6A, while the two wires W are passed through the opening 60*a* of the fixed blade portion 60, by the rotational operation of the movable blade portion 61 with the fixed blade portion 60 as a shaft, the blade portion 61*a* of the movable blade portion 61 moves in the direction indicated by the arrow E1 from the standby position. The rotational operation of the movable blade portion 61 is in conjunction with the operation of the binding portion 7A which will be described later.

When the blade portion 61*a* of the movable blade portion 61 moves in the direction indicated by the arrow E1 from the standby position, one wire W1 of the two parallel wires W is pressed against the first abutting blade portion 60*b* of the fixed blade portion 60 by the blade portion 61*a*. The other wire W2 is pressed by the blade portion 61*a* and is bent along the movement direction of the blade portion 61*a*, and enters the retraction recess portion 60*d* of the fixed blade portion 60. Accordingly, a shearing force is applied to the one wire W1, and cutting of the one wire W1 starts prior to cutting of the other wire W2.

The blade portion 61*a* moves in the direction indicated by the arrow E1 by the rotational operation of the movable blade portion 61 with the fixed blade portion 60 as a shaft, whereby after the cutting of the one wire W1 is started, when the one wire W1 is cut to a predetermined position, the other wire W2 is pressed against the second abutting blade portion 60*c* by the blade portion 61*a*. Accordingly, the cutting of the other wire W2 is started.

Figure 5B:
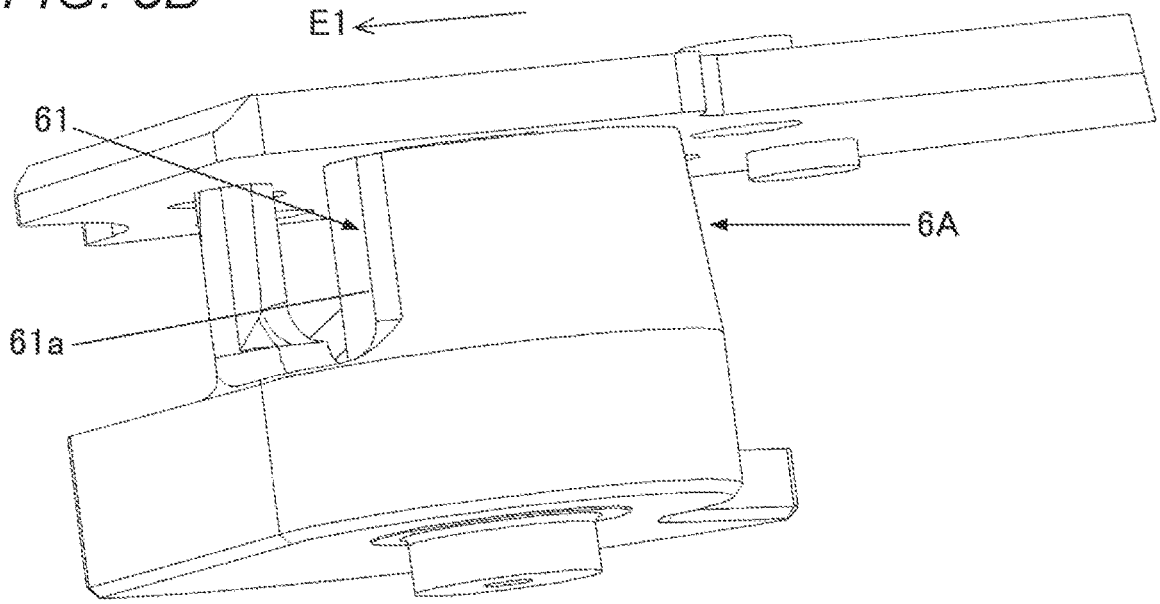
FIG. 5B is a perspective view which shows an example of the operation of cutting the wires by the cutting portion.

When the blade portion 61*a* further moves in the direction indicated by the arrow E1 by the rotational operation of the movable blade portion 61 with the fixed blade portion 60 as a shaft, the cutting of the wire W1, which is started in advance, is completed. Then, when the blade portion 61*a* moves further in the direction indicated by the arrow E1 to a cutting completion position as shown in FIG. 5B, the cutting of the other wire W2, which is started with a delay, is completed.

Figure 5C:
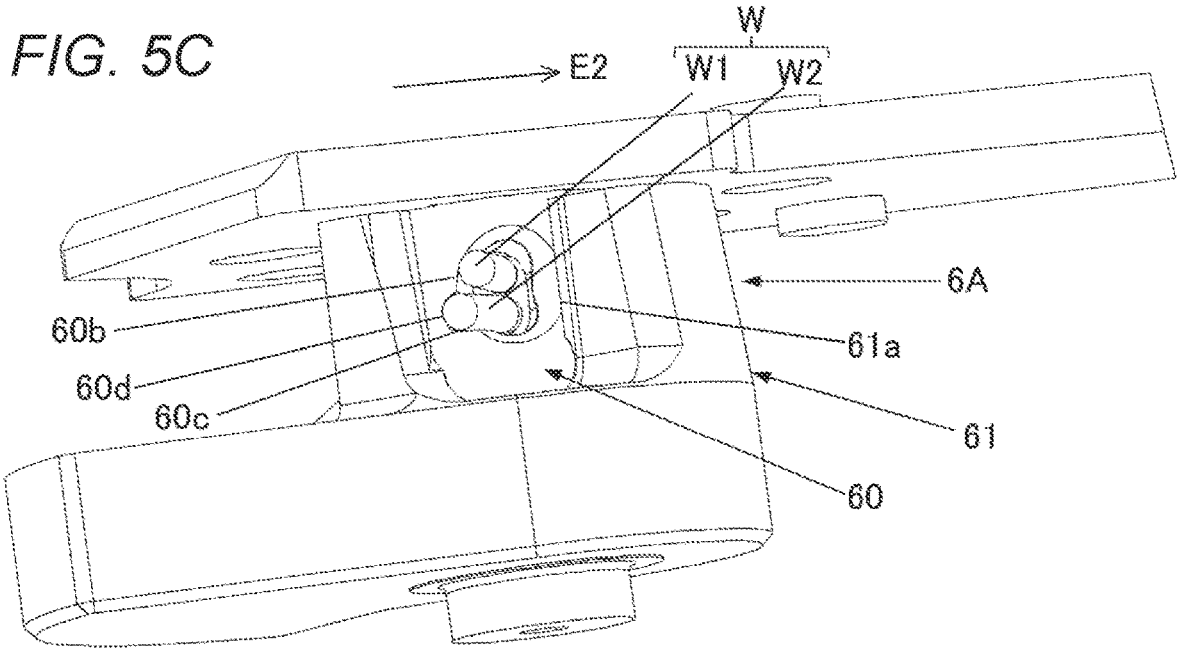
FIG. 5C is a perspective view which shows an example of the operation of cutting the wires by the cutting portion.
Figure 5D:
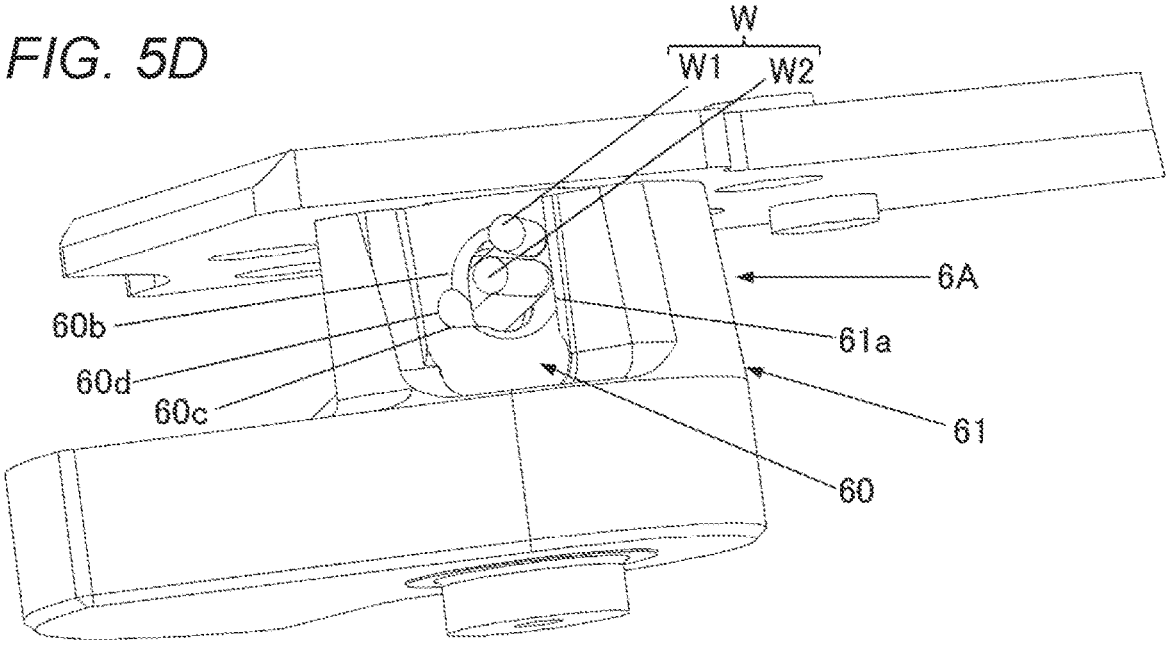
FIG. 5D is a perspective view which shows an example of the operation of cutting the wires by the cutting portion.

When the cutting of the wires W is completed, by the rotational operation of the movable blade portion 61 with the fixed blade portion 60 as a shaft, the blade portion 61*a* moves in the direction indicated by the arrow E2 and returns to the standby position as shown in FIG. 5C. In the two wires W cut by the above-described operation of the cutting portion 6A, the distal end side of the other wire W2 is bent along the movement direction of the blade portion 61*a* with respect to the one wire W1. As shown in FIG. 5D, the direction where a distal end side of the other wire W2 is bent is a direction where the wire W is fed in the forward direction and faces the inner peripheral side of the looped feeding path Ru when the distal end of the wire W reaches the curl guide 50*a*. The one wire W1 is fed in contact with the feeding gear 30L which is the drive side, and the other wire W2 is fed in contact with the feeding gear 30R which is the driven side.

Figure 6A:
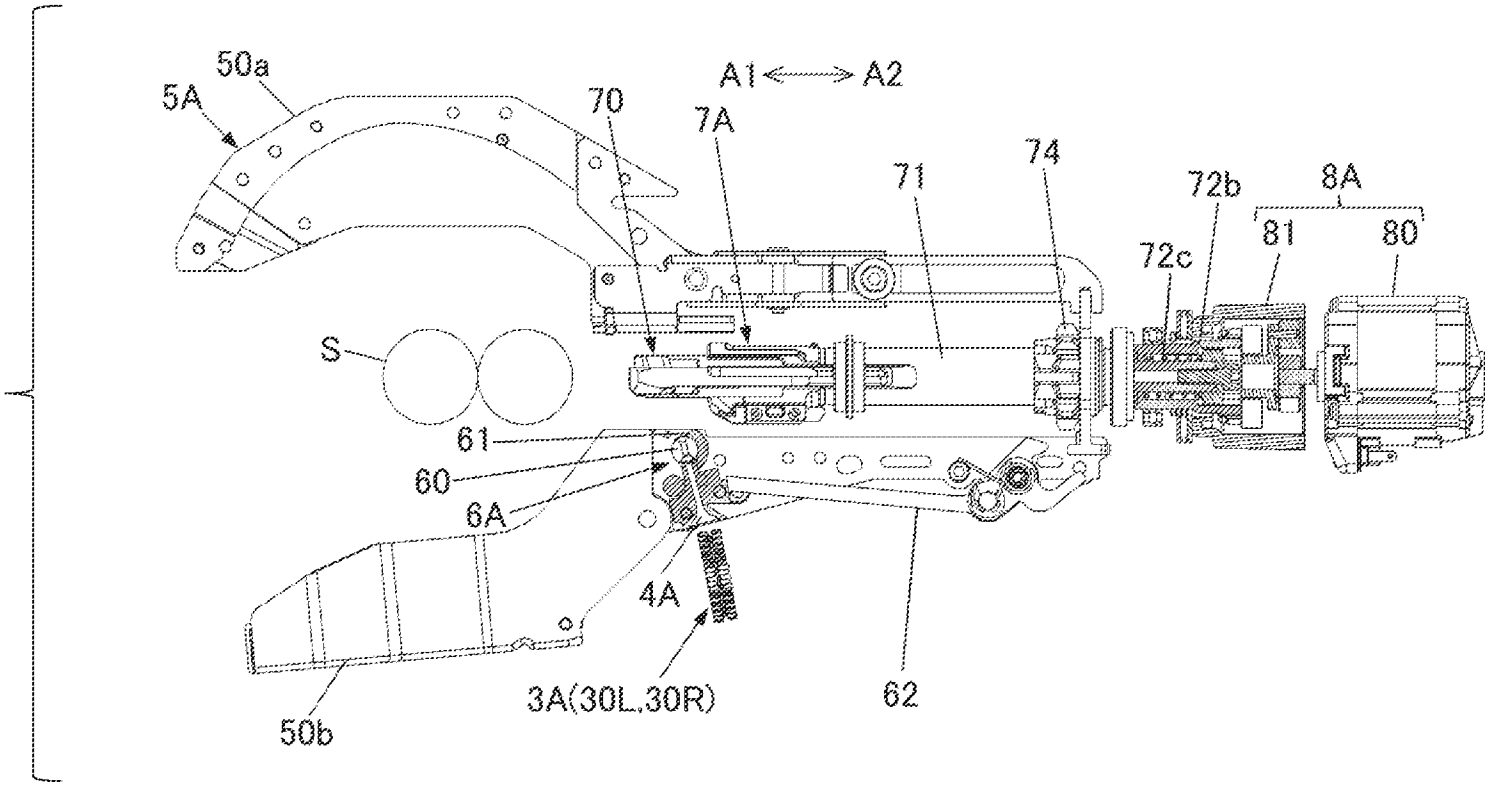
FIG. 6A is a side cross-sectional view of the main part, which shows an example of an operation of the reinforcing bar binding machine according to the first embodiment.
Figure 6B:
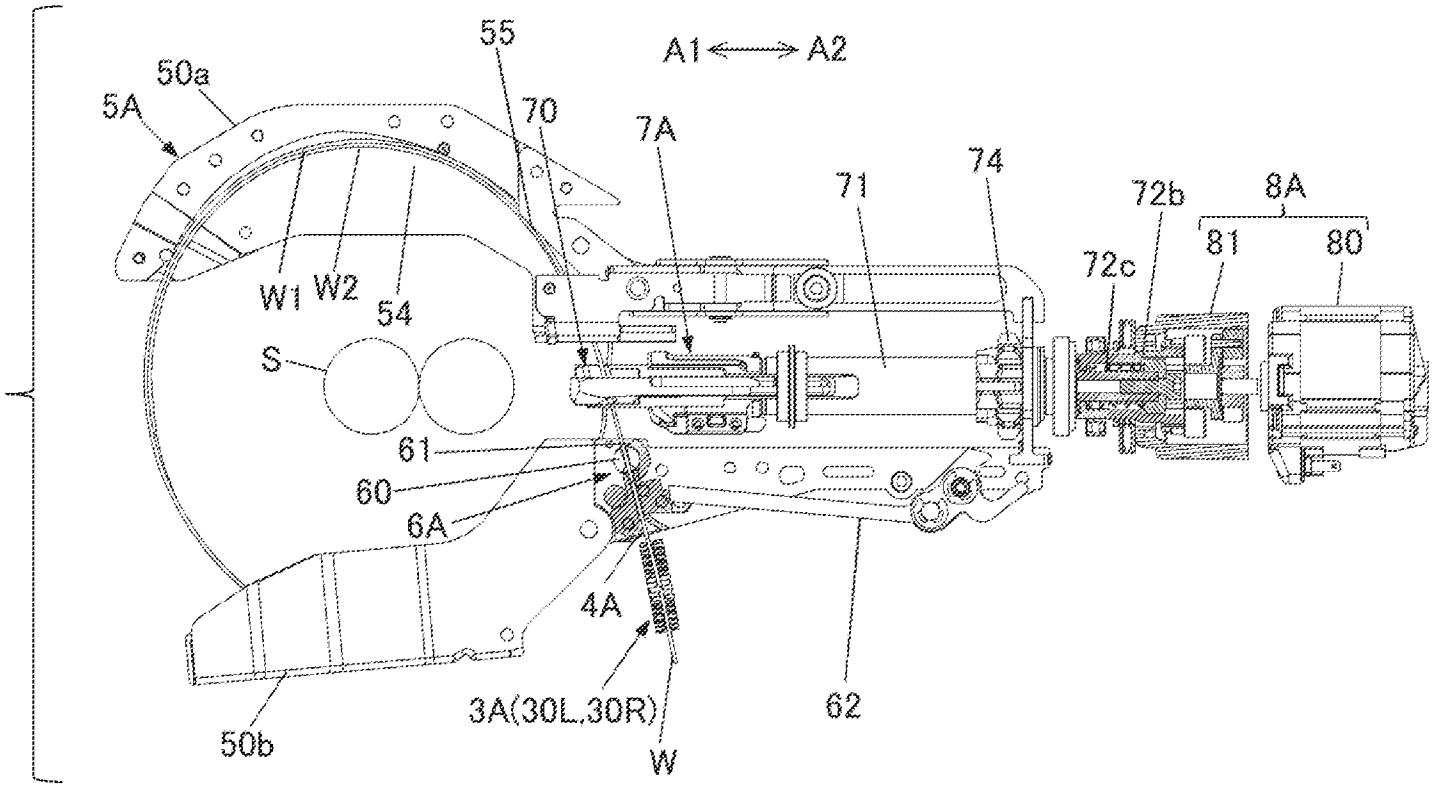
FIG. 6B is a side cross-sectional view of the main part, which shows an example of the operation of the reinforcing bar binding machine according to the first embodiment.
Figure 6C:
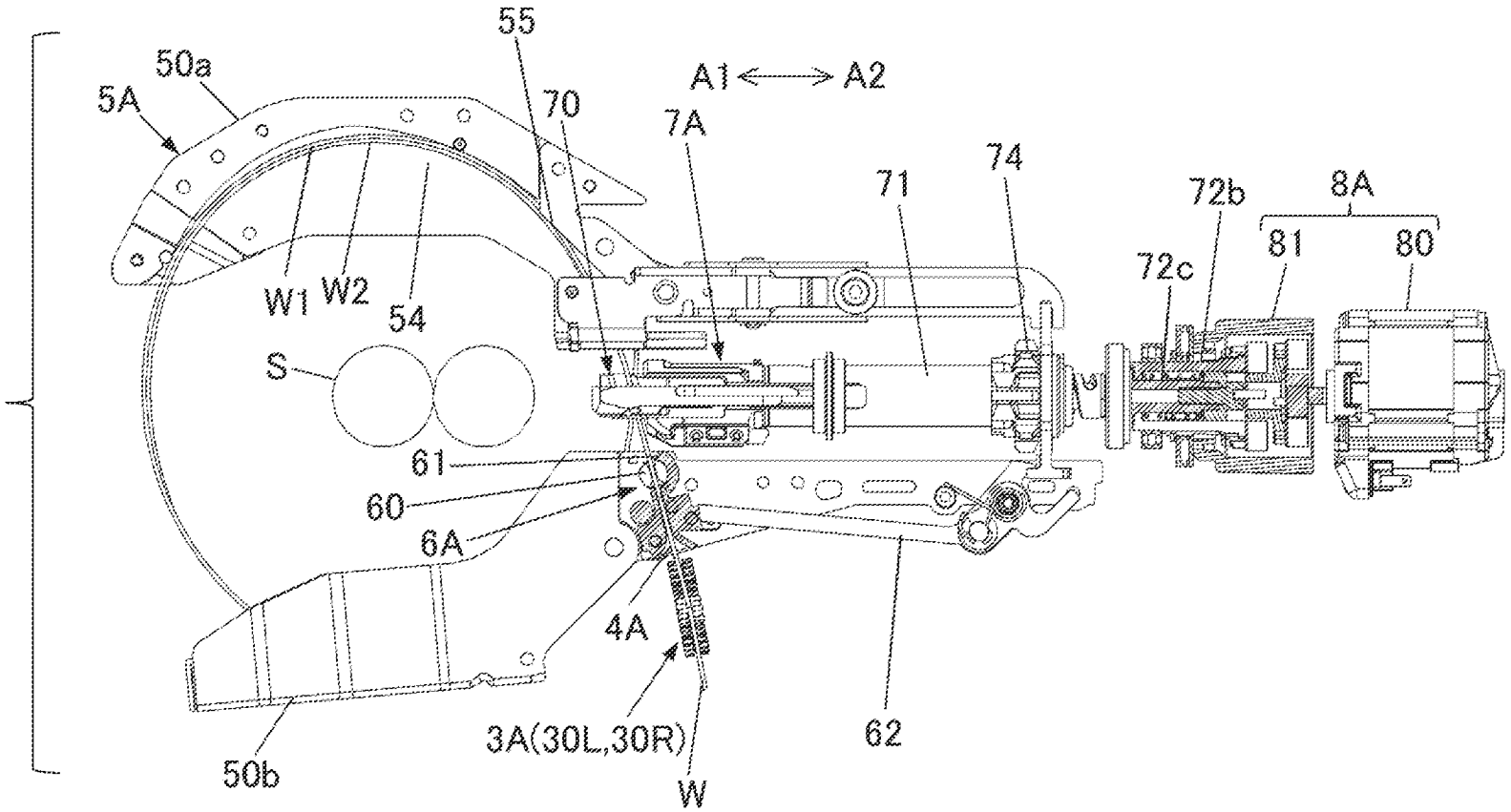
FIG. 6C is a side cross-sectional view of the main part, which shows an example of the operation of the reinforcing bar binding machine according to the first embodiment.
Figure 6D:
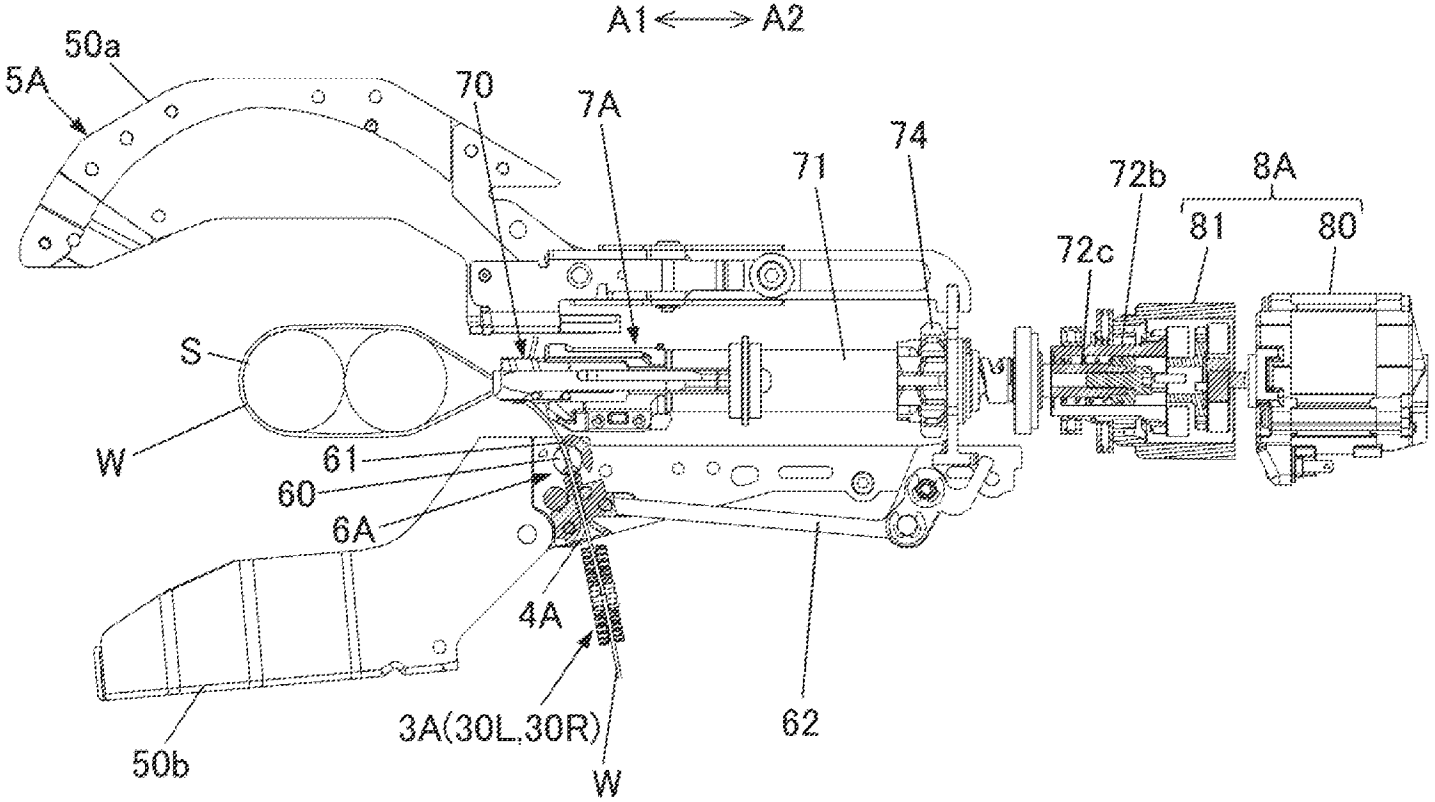
FIG. 6D is a side cross-sectional view of the main part, which shows an example of the operation of the reinforcing bar binding machine according to the first embodiment.
Figure 6E:
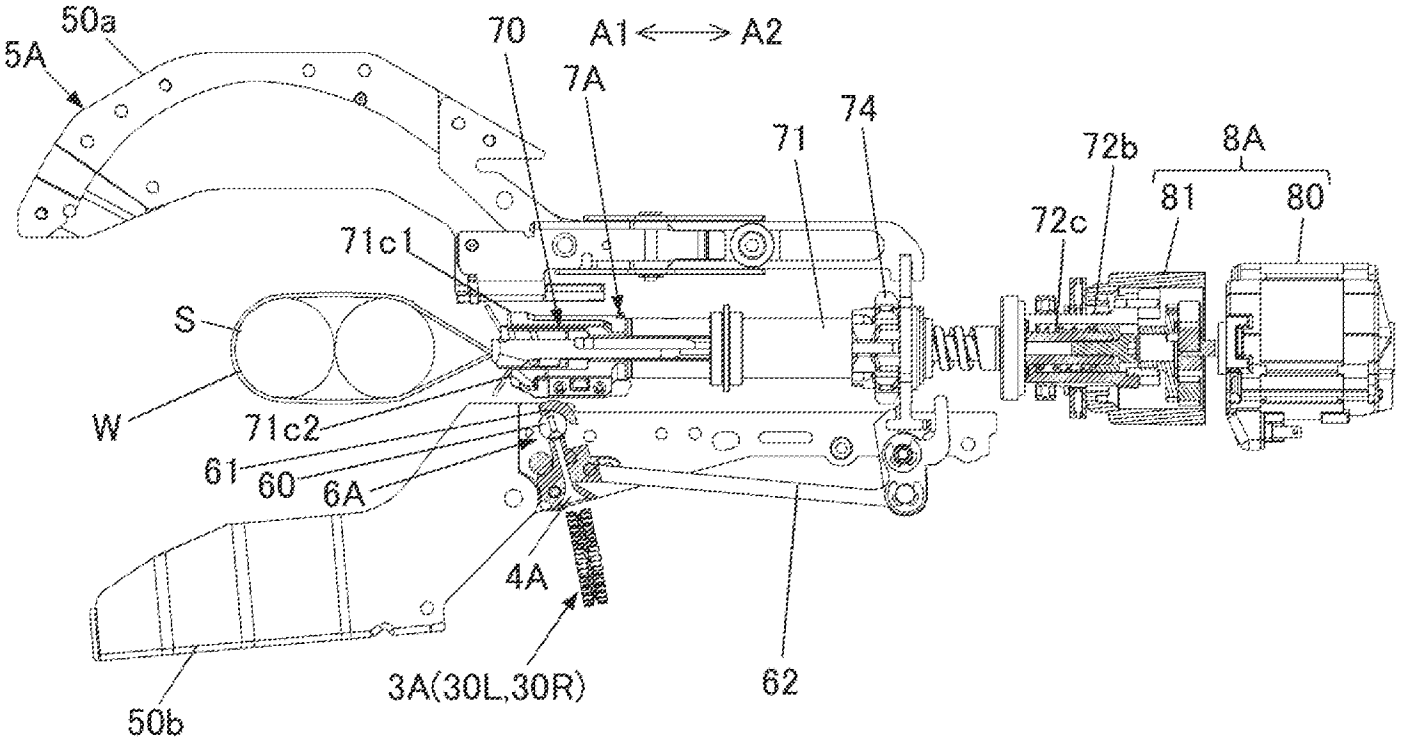
FIG. 6E is a side cross-sectional view of the main part, which shows an example of the operation of the reinforcing bar binding machine according to the first embodiment.
Figure 6F:
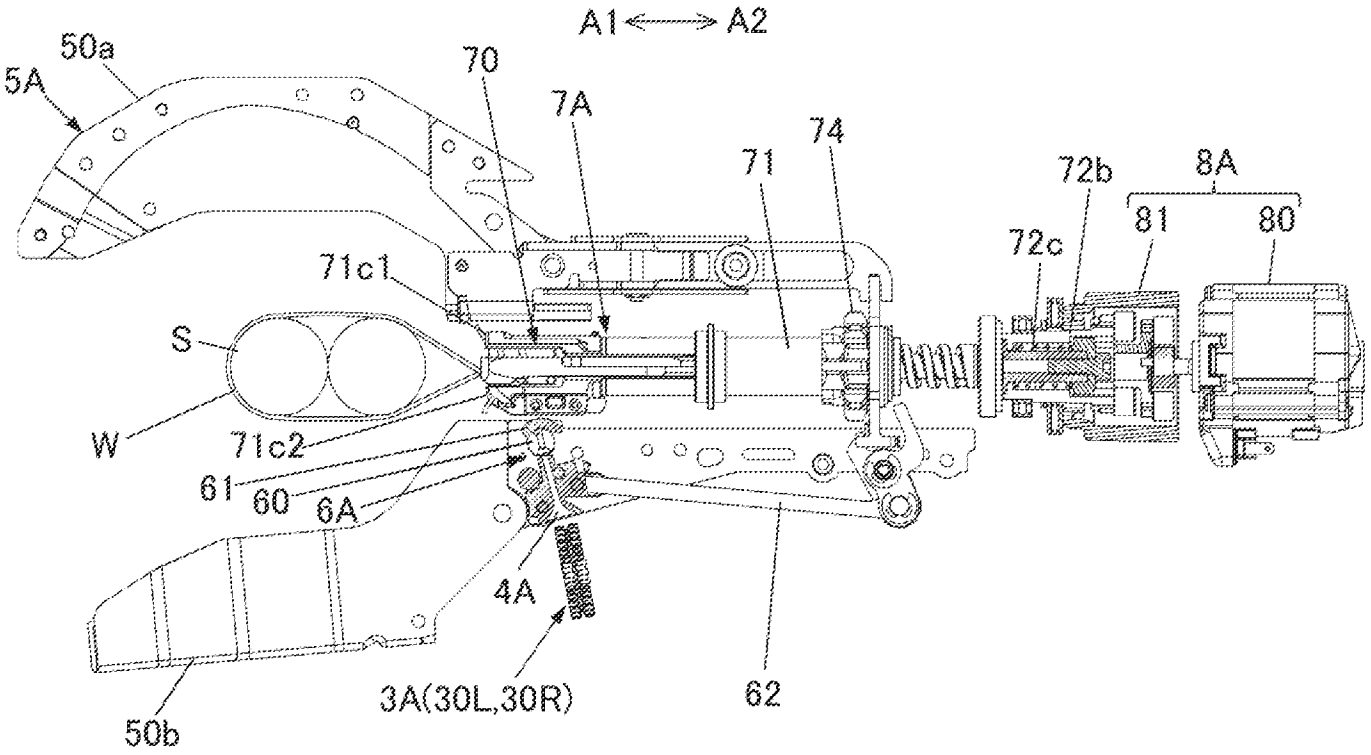
FIG. 6F is a side cross-sectional view of the main part, which shows an example of the operation of the reinforcing bar binding machine according to the first embodiment.
Figure 6G:
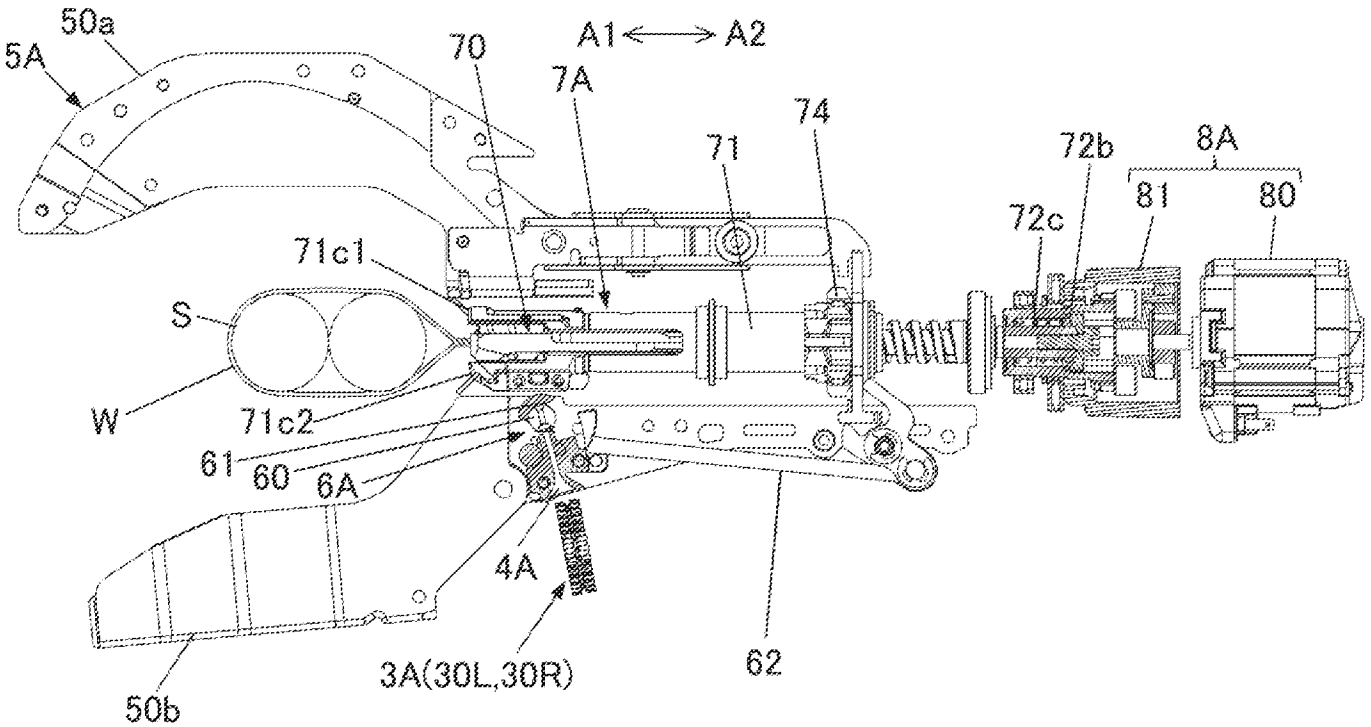
FIG. 6G is a side cross-sectional view of the main part, which shows an example of the operation of the reinforcing bar binding machine according to the first embodiment.
Figure 6H:
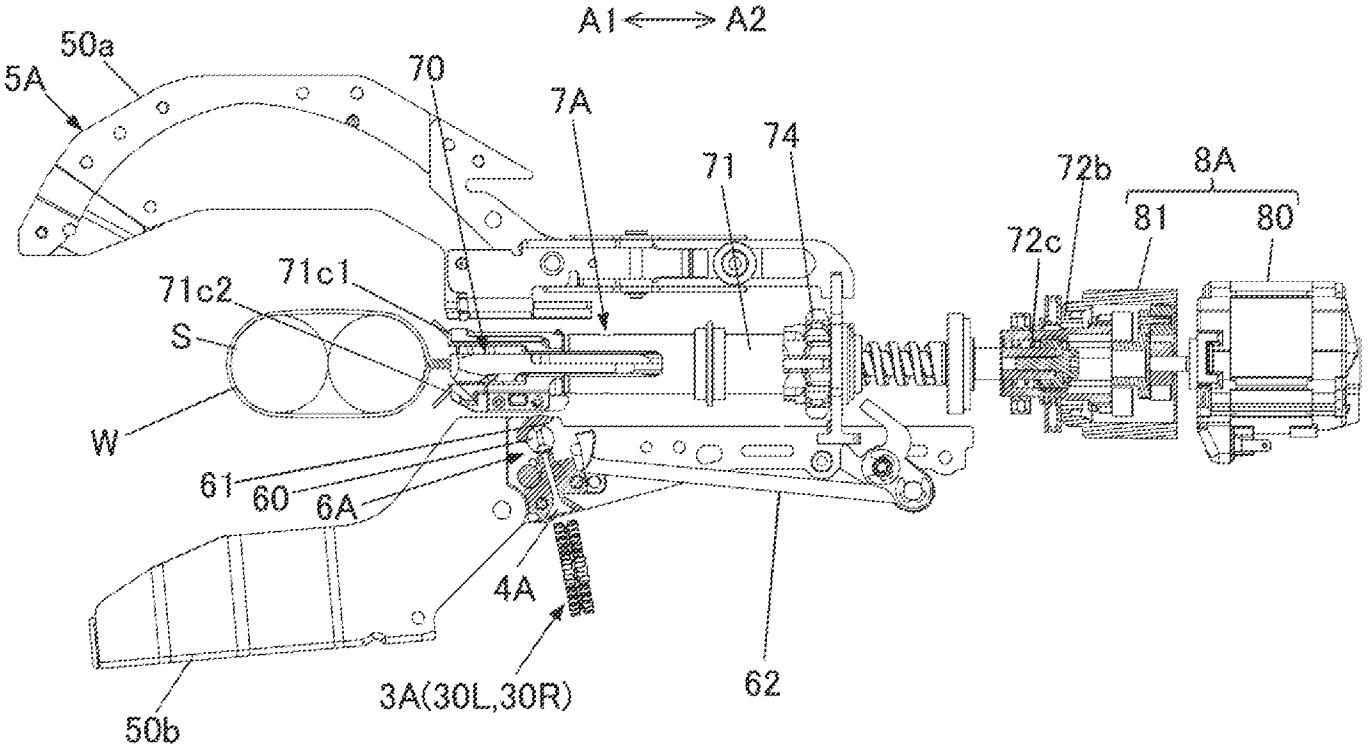
FIG. 6H is a side cross-sectional view of the main part, which shows an example of the operation of the reinforcing bar binding machine according to the first embodiment.

FIG. 6A, FIG. 6B, FIG. 6C, FIG. 6D, FIG. 6E, FIG. 6F, FIG. 6G, and FIG. 6H are side cross-sectional views of the main part, which show an example of the operation of the reinforcing bar binding machine according to the first embodiment. FIG. 6A shows a state where the reinforcing bars S are placed at a position where the reinforcing bars S can be bound. FIG. 6B shows the operation of feeding the wires W in the forward direction and winding the wires W around the reinforcing bars S. FIG. 6C shows the operation of locking the wires W wound around the reinforcing bars S. FIG. 6D shows the operation of feeding the wires W in the reverse direction and winding the wires W around the reinforcing bars S. FIG. 6E shows the operation of cutting a remaining portion of the wires W wound around the reinforcing bars S. FIG. 6F shows the operation of bending the wires W wound around the reinforcing bars S. FIG. 6G and FIG. 6H show the operation of twisting the wires W wound around the reinforcing bars S.

Next, the operation of binding the reinforcing bars S with the wires W by the reinforcing bar binding machine 1A according to the first embodiment will be described with reference to the drawings.

In the reinforcing bar binding machine 1A, the two wires W are sandwiched between the pair of feeding gears 30 (30L and 30R), a standby state is a state where the distal end of each wire W is positioned between a sandwiching position of the feeding gear 30 (30L and 30R) and the fixed blade portion 60 of the cutting portion 6A. In the reinforcing bar binding machine 1A, in the standby state, the sleeve 71 and the wire locking body 70 having the first side hook 70R, the second side hook 70L, and the center hook 70C attached to the sleeve 71 move in a rearward direction indicated by the arrow A2, and as shown in FIG. 4A, the first side hook 70R is opened with respect to the center hook 70C, and the second side hook 70L is opened with respect to the center hook 70C.

As shown in FIG. 6A, when the reinforcing bars S enters between the curl guide 50*a* and the leading guide 50*b* of the curl forming portion 5A and the trigger 12A is operated, the feeding motor 31 is driven in a forward rotation direction, and as shown in FIG. 6B, the two wires W are fed in the forward direction indicated by the arrow F by the wire feeding portion 3A.

The two wires W fed in the forward direction by the wire feeding portion 3A are oriented in parallel along the axial direction of the looped feeding path Ru by the wire guide 4A on the upstream side of the curl guide 50*a*.

The two wires W fed in the forward direction pass between the center hook 70C and the first side hook 70R and are fed to the curl guide 50*a* of the curl forming portion 5A. By passing through the curl guide 50*a*, the two wires W are curled around the reinforcing bars S along the looped feeding path Ru. By passing through the curl guide 50*a*, the two wires W are led to be oriented to be arranged in the radial direction of the looped feeding path Ru. The two wires W pass through the curl guide 50*a* while being arranged in the radial direction of the looped feeding path Ru.

Figure 7A:
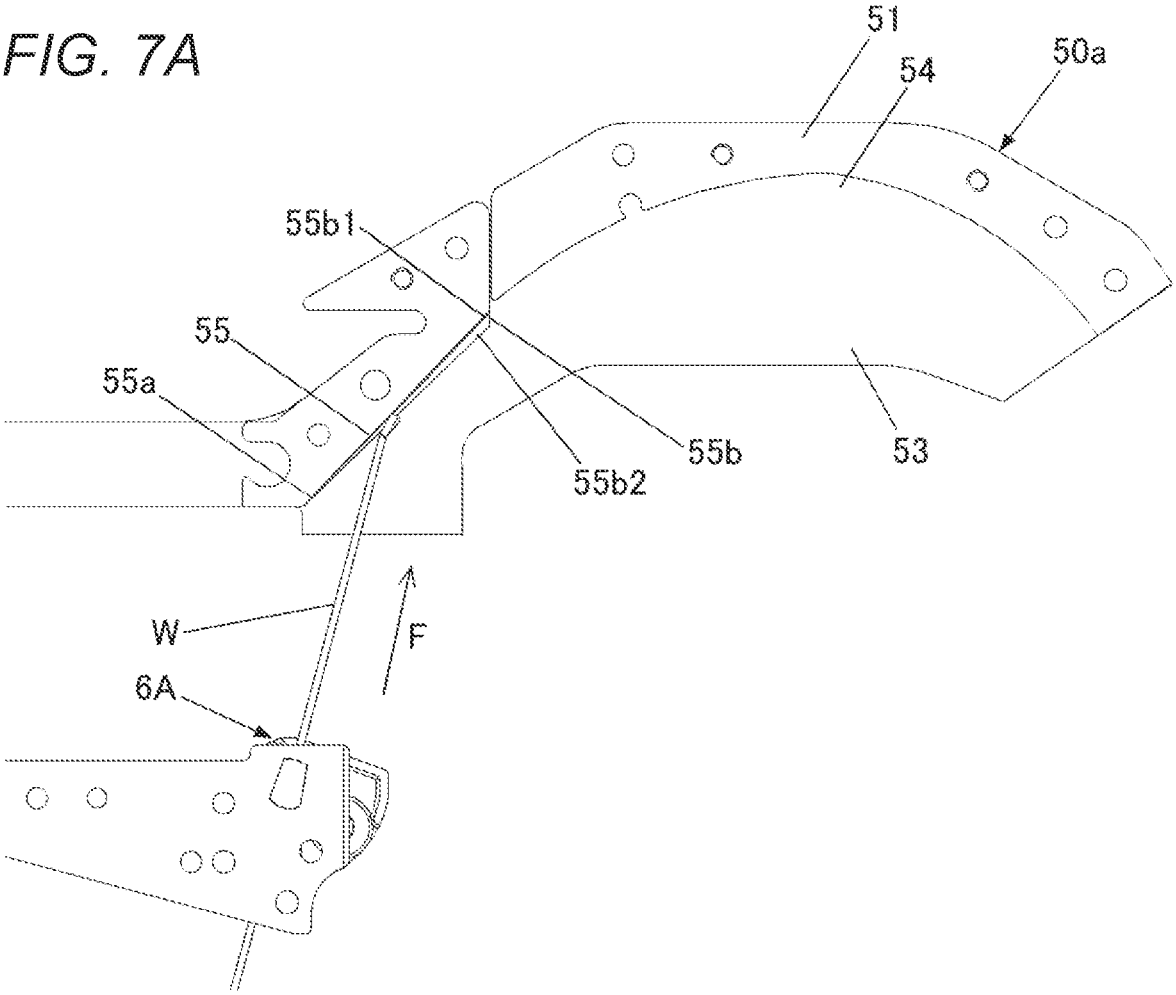
FIG. 7A is a side view which shows an example of an operation of leading an orientation where the wires are arranged in parallel in the curl guide.

FIG. 7A is a side view which shows an example of an operation of leading the orientation where the wires are arranged in parallel in the curl guide, FIG. 7B is an enlarged side view of the main part, which shows an example of the operation of leading the orientation where the wires are arranged in parallel in the curl guide, and FIG. 7C is an enlarged perspective view of the main part, which shows an example of the operation of leading the orientation where the wires are arranged in parallel in the curl guide.

In the distal end sides of the two wires which are cut by the cutting operation on the two wires W performed by the above-described cutting portion 6A, when the distal ends of the wires W reach the curl guide 50*a*, with respect to the one wire W1 fed in contact with the feeding gear 30L which is the drive side, the distal end side of the other wire W2 fed in contact with the feeding gear 30R which is the driven side is bent in a direction facing the inner peripheral side of the looped feeding path Ru.

In a next binding operation, when the two wires W are fed in the forward direction by the wire feeding portion 3A, the distal end sides of the two wires W cut in the previous binding operation pass through the parallel orientation leading portion 55 of the curl guide 50*a*. The one wire W1 of the two wires W fed by the wire feeding portion 3A and passing through the parallel orientation leading portion 55 comes into contact with the first leading portion 55*b*1 of the parallel orientation leading portion 55. On the other hand, the other wire W2 comes into in contact with the second leading portion 55*b*2 of the parallel orientation leading portion 55.

In the parallel orientation leading portion 55, from the introduction portion 55*a* toward the delivery portion 55*b*, with respect to the first leading portion 55*b*1 with which the one wire W1 is in contact, the second leading portion 55*b*2 with which the other wire W2 is in contact is inclined in a direction protruding to the inner peripheral side along the radial direction of the looped feeding path Ru.

Accordingly, in the two wires W fed in the forward direction by the wire feeding portion 3A and passing through the parallel orientation leading portion 55, with respect to the one wire W1 in contact with the first leading portion 55*b*1, the other wire W2 in contact with the second leading portion 55*b*2 is led toward the inner peripheral side along the radial direction of the looped feeding path Ru.

The two wires W fed in the forward direction by the wire feeding portion 3A and led by the parallel orientation leading portion 55 to be oriented to be arranged in the radial direction of the looped feeding path Ru enter the parallel guide portion 54 from the delivery portion 55*b* of the parallel orientation leading portion 55.

The parallel guide portion 54 is configured such that the gap Ra1 between the second guide surface 52*a* of the second wire guide 52 and the third guide surface 53*a* of the third wire guide 53 is longer than the diameter Rb of the wires W and shorter than twice the diameter Rb of the wires W.

Accordingly, the two wires W fed in the forward direction by the wire feeding portion 3A and entering the parallel guide portion 54 from the delivery portion 55*b* of the parallel orientation leading portion 55 pass through the curl guide 50*a* while being arranged in the radial direction of the looped feeding path Ru due to the regulation by the gap Ra1 between the second guide surface 52*a* and the third guide surface 53*a* of the parallel guide portion 54 as shown in FIG. 6B.

The two wires W that are curled by the curl guide 50*a* and arranged in parallel in the radial direction of the looped feeding path Ru are led by the leading guide 50*b*, and further fed in the forward direction by the wire feeding portion 3A, whereby the wires are led between the center hook 70C and the second side hook 70L by the leading guide 50*b*. Then, the two wires W are fed until the distal ends abut against the feeding regulation portion 90. When the distal ends of the wires W are fed to a position at which the distal ends of the wires W abut against the feeding regulation portion 90, driving of the feeding motor 31 is stopped.

After the feeding of the wires W in the forward direction is stopped, the motor 80 is driven in the forward rotation direction. In the sleeve 71, the rotation of the sleeve 71 in conjunction with the rotation of the rotation shaft 72 is regulated by the rotation regulation portion 74 in an operation range in which the wires W are locked by the wire locking body 70. Accordingly, as shown in FIG. 6C, the rotation of the motor 80 is converted into the linear movement, and the sleeve 71 moves in the direction indicated by the arrow A1 which is the forward direction.

When the sleeve 71 moves in the forward direction, the opening and closing pin 71*a* passes through the opening and closing guide holes 73. Accordingly, the first side hook 70R moves in the direction approaching the center hook 70C by the rotational operation with the shaft 71*b* as a fulcrum. When the first side hook 70R is closed with respect to the center hook 70C, the wires W sandwiched between the first side hook 70R and the center hook 70C are locked in a manner of being movable between the first side hook 70R and the center hook 70C.

The second side hook 70L moves in the direction approaching the center hook 70C by the rotational operation with the shaft 71*b* as a fulcrum. When the second side hook 70L is closed with respect to the center hook 70C, the wires W sandwiched between the second side hook 70L and the center hook 70C are locked in a manner that the wires W do not come out from the portion between the second side hook 70L and the center hook 70C.

After the sleeve 71 is advanced to the position where the wires W are locked by the operation of closing the first side hook 70R and the second side hook 70L, the rotation of the motor 80 is temporarily stopped, and the feeding motor 31 is driven in the reverse rotation direction.

Accordingly, the pair of feeding gears 30 (30L and 30R) rotate in reverse, and as shown in FIG. 6D, the two wires W sandwiched between the pair of feeding gears 30 (30L and 30R) are fed in the reverse direction indicated by the arrow R. The distal end sides of the two wires W are locked so as not to come off from the portion between the second side hook 70L and the center hook 70C, and thus, the wires W are wound around the reinforcing bars S by feeding the wires W in the reverse directions.

The wires W are wound around the reinforcing bars S, and the driving of the feeding motor 31 in the reverse rotation direction is stopped, and then the motor 80 is driven in the forward rotation direction to move the sleeve 71 in the forward direction indicated by the arrow A1. As shown in FIG. 6E, an operation of the sleeve 71 moving in the forward direction is transmitted to the cutting portion 6A by the transmission mechanism 62, thereby the movable blade portion 61 rotates, and the wires W locked by the first side hook 70R and the center hook 70C are cut by the operation of the fixed blade portion 60 and the movable blade portion 61.

The motor 80 drives in the forward rotation direction, thereby the sleeve 71 moves in the forward direction indicated by the arrow A1 to cut the two wires W, and the bending portions 71*c*1 and 71*c*2 move in a direction approaching the reinforcing bars S almost at the same time. Accordingly, the distal end sides of the two wires W locked by the center hook 70C and the first side hook 70R are pressed toward the reinforcing bars S by the bending portion 71*c*1, and are bent toward the reinforcing bars S with a locking position as a fulcrum. The sleeve 71 further moves in the forward direction, thereby the wires W locked between the second side hook 70L and the center hook 70C are held in a state of being sandwiched by the bending portion 71*c*1.

The terminal end sides of the wires W locked by the center hook 70C and the first side hook 70R and cut by the cutting portion 6A are pressed toward the reinforcing bars S by the bending portion 71*c*2, and are bent toward the reinforcing bars S with a locking position as a fulcrum. The sleeve 71 further moves in the forward direction, thereby the wires W locked between the first side hook 70R and the center hook 70C are held in a state of being sandwiched by the bending portion 71*c*2. In the operation range in which the wires W are bent and formed, the rotation of the sleeve 71 in conjunction with the rotation of the rotation shaft 72 is regulated by the rotation regulation portion 74, and the sleeve 71 moves in the forward direction without rotating.

After the distal end sides and the terminal end sides of the two wires W are bent toward the reinforcing bars S, the motor 80 is further driven in the forward rotation direction, thereby the sleeve 71 further moves in the forward direction. When the sleeve 71 moves to a predetermined position, the regulation on the rotation of the sleeve 71 by the rotation regulation portion 74 is released.

Accordingly, the motor 80 is further driven in the forward rotation direction, thereby the sleeve 71 rotates in conjunction with the rotation shaft 72, and the two wires W locked by the wire locking body 70 start to be twisted as shown in FIG. 6F.

In the binding portion 7A, in the operation range where the sleeve 71 rotates and the wire W is twisted, the wire W locked by the wire locking body 70 is twisted, thereby a force that pulls the wire locking body 70 forward along the axial direction of the rotation shaft 72 is applied. On the other hand, the rotation shaft 72 receives a force that is pressed rearward by the spring 72*c*. Accordingly, the wire locking body 70 moves forward while the rotation shaft 72 receives the force that is pressed rearward by the spring 72*c*, and the wires W are twisted while the wire locking body 70 moves forward as shown in FIG. 6G.

In the operation range where the sleeve 71 rotates and the wires W are twisted, when the wire locking body 70 further rotates in conjunction with the rotation shaft 72, the binding portion 7A further twists the wires W while the wire locking body 70 and the rotation shaft 72 move in the forward direction which is the direction where the gap between the twisted portion of the wires W and the reinforcing bars S becomes smaller.

Therefore, as shown in FIG. 6H, the two twisted wires W closely adhere to the reinforcing bars S along the reinforcing bars S with a narrow gap between the twisted portion of the wires W and the reinforcing bars S.

When it is detected that the load applied to the motor 80 is maximized by twisting the two wires W, the forward rotation of the motor 80 is stopped. Next, by driving the motor 80 in the reverse rotation direction, when the rotation shaft 72 rotates in the reverse direction and the sleeve 71 rotates in the reverse direction following the reverse rotation of the rotation shaft 72, the rotation of the sleeve 71 in conjunction with the rotation of the rotation shaft 72 is regulated by the rotation regulation portion 74. Accordingly, the sleeve 71 moves in the direction indicated by the arrow A2 which is the rearward direction.

When the sleeve 71 moves in the rearward direction, the bending portions 71*c*1 and 71*c*2 are separated from the wires W, and the wires W are no longer held by the bending portions 71*c*1 and 71*c*2. Further, when the sleeve 71 moves in the rearward direction, the opening and closing pin 71*a* passes through the opening and closing guide hole 73. Accordingly, the first side hook 70R moves in the direction away from the center hook 70C by the rotational operation with the shaft 71*b* as a fulcrum. The second side hook 70L moves in the direction away from the center hook 70C by the rotational operation with the shaft 71*b* as a fulcrum. Accordingly, the two wires W that bind the reinforcing bars S are removed from the wire locking body 70.

Figure 8B:
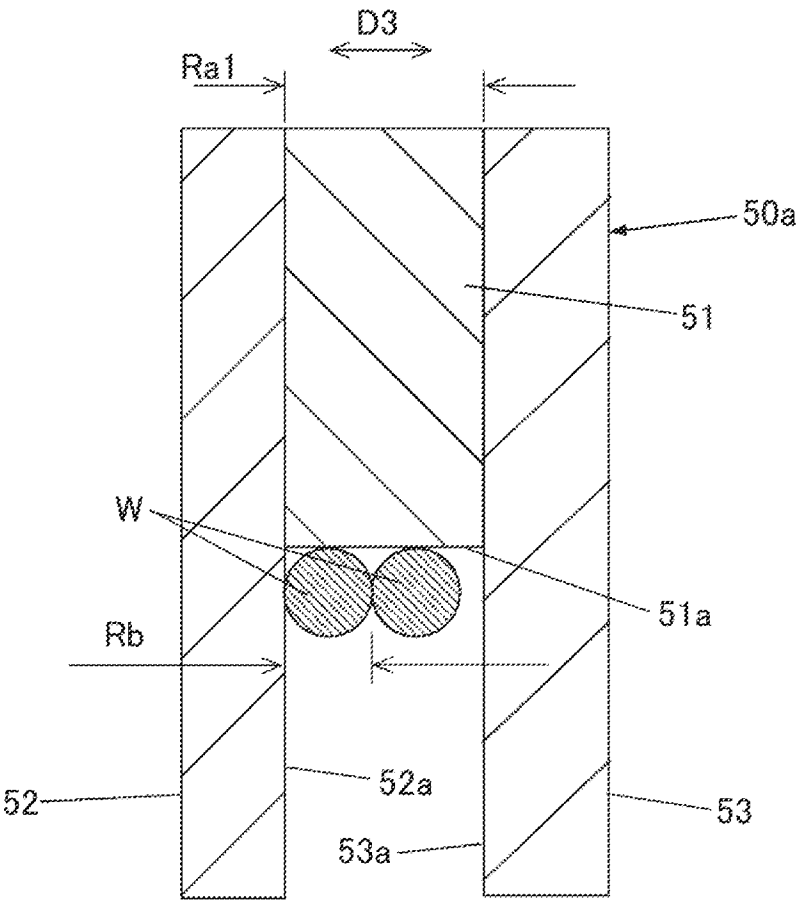
FIG. 8B is a front cross-sectional view of a curl guide, which shows an example of a problem of a reinforcing bar binding machine in the related art.
Figure 8A:
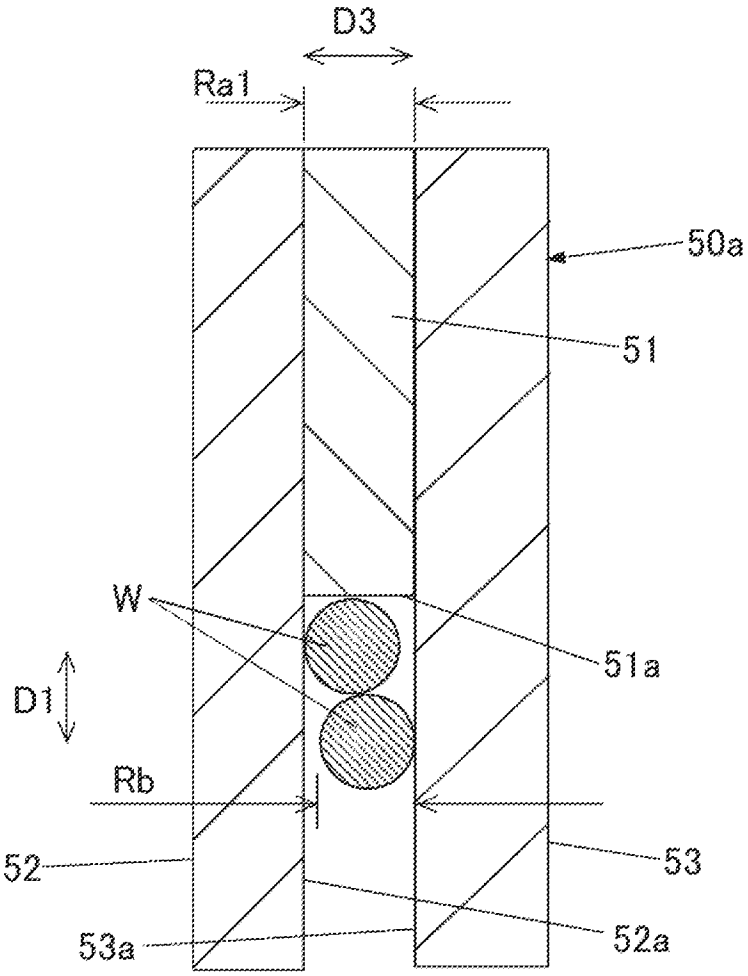
FIG. 8A is a front cross-sectional view of the curl guide, which shows an example of an action and effect of the reinforcing bar binding machine according to the present embodiment.

Example of Action and Effect of Reinforcing Bar Binding Machine According to First Embodiment FIG. 8A is a front cross-sectional view of the curl guide, which shows an example of an action and effect of the reinforcing bar binding machine according to the present embodiment, and FIG. 8B is a front cross-sectional view of a curl guide, which shows an example of a problem of a reinforcing bar binding machine in the related art.

In the reinforcing bar binding machine 1A, the reel 20 is disposed while being offset in one direction. From the reel 20 offset in this one direction, the wires W fed by the wire feeding portion 3A and curled by the curl guide 50*a* are oriented in the other direction which is opposite to the one direction where the reel 20 is offset.

In the reinforcing bar binding machine with such a configuration, as shown in FIG. 8B, in the reinforcing bar binding machine that binds the reinforcing bars S with two wires W in the related art, in the curl guide 50*a*, the gap Ra1

(referred to as an inner width of the curl guide) between the second guide surface 52*a* of the second wire guide 52 and the third guide surface 53*a* of the third wire guide 53 is longer than twice the diameter Rb of the wires W. With such a configuration, the two wires W can be fed while being arranged in the axial direction of the looped feeding path Ru indicated by an arrow D3.

However, in a configuration in which the inner width of the curl guide is longer than twice the diameter Rb of the wires W, each wire W is longer than the diameter Rb of the wire W, and can move in the axial direction (referred to as left-right direction) of the looped feeding path Ru. In the curl guide 50*a*, if a movable amount in the left-right direction of the wires W increases, the positions of the distal ends of the wires W curled by the curl guide 50*a* due to the operation of feeding the wires W in the forward direction becomes unstable, and a displacement amount in the left-right direction increases. Therefore, there is a possibility that the distal ends of the wires W that are curled by the curl guide 50*a* will not enter the leading guide 50*b*. There is a possibility that the left and right of the one wire W and the other wire W are interchanged within the curl guide 50*a*, and the two wires W may be twisted within the curl guide 50*a*.

On the other hand, in the reinforcing bar binding machine 1A according to the present embodiment that binds the reinforcing bars S with the two wires W, in the curl guide 50*a*, the gap Ra1 between the second guide surface 52*a* of the second wire guide 52 and the third guide surface 53*a* of the third wire guide 53 is configured to be longer than the diameter Rb of the wire W and shorter than twice the diameter Rb of the wire W. With such a configuration, the two wires W can be fed while being arranged in the radial direction of the looped feeding path Ru indicated by the arrow D1.

Accordingly, in the curl guide 50*a*, the movable amount in the left-right direction of the wires W decreases, the positions of the distal ends of the wires W curled by the curl guide 50*a* due to the operation of feeding the wires Win the forward direction becomes stable, and the displacement amount in the left-right direction decreases, so that it is suppressed that the distal ends of the wires W does not enter the leading guide 50*b*. There is no possibility that the left and right of the one wire W and the other wire W are interchanged within the curl guide 50*a*, and the twisting of the two wires W within the curl guide 50*a* is suppressed.

Figure 9:
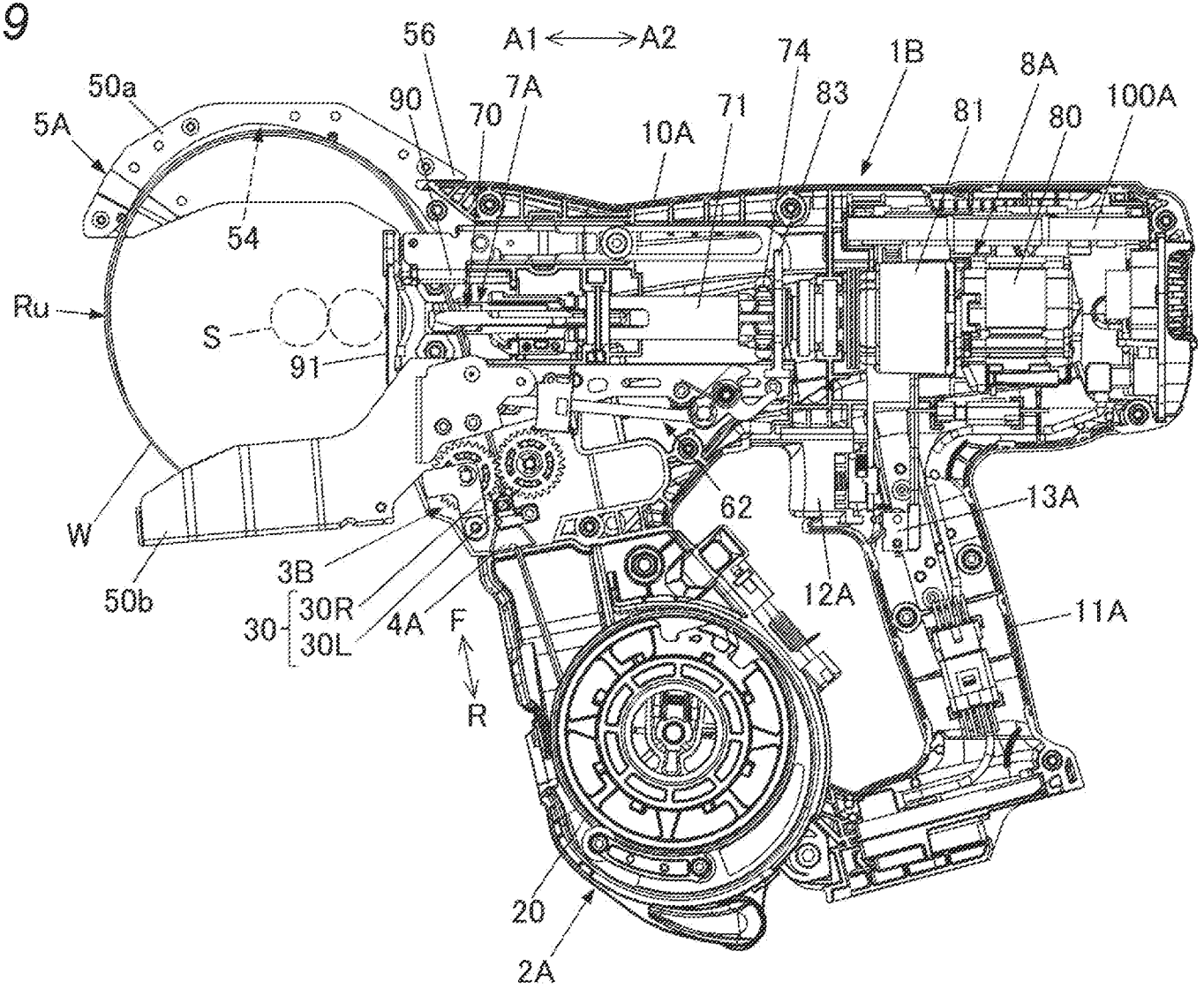
FIG. 9 is an internal configuration diagram seen from a side, which shows an example of an overall configuration of a reinforcing bar binding machine according to a second embodiment.

Configuration Example of Reinforcing Bar Binding Machine According to Second Embodiment FIG. 9 is an internal configuration diagram seen from a side, which shows an example of an overall configuration of a reinforcing bar binding machine according to a second embodiment. An overall configuration of a reinforcing bar binding machine 1B according to the second embodiment is equivalent to that of the reinforcing bar binding machine 1A according to the first embodiment, the same components as those of the reinforcing bar binding machine 1A according to the first embodiment are denoted by the same signs, and detailed descriptions thereof will be omitted.

The reinforcing bar binding machine 1B according to the second embodiment includes a wire feeding portion 3B in which the pair of feeding gears 30 (30L and 30R) are opposed to each other along the radial direction of the looped feeding path Ru.

In the wire feeding portion 3B, by sandwiching the two wires W between the pair of feeding gears 30 (30L and 30R), the two wires W are arranged in parallel along the direction where the pair of feeding gears 30L and 30R are arranged and in the orientation along the radial direction of the looped feeding path Ru. Accordingly, by the rotation of the pair of feeding gears 30 (30L and 30R), the wire feeding portion 3B feeds, in the orientation along the radial direction of the looped feeding path Ru and along the extending direction of the wires W, the two wires W sandwiched between the pair of feeding gears 30 (30L and 30R) due to the frictional force generated between the one feeding gear 30L and the one wire W, the frictional force generated between the other feeding gear 30R and the other wire W, and the frictional force generated between the two wires W.

Figure 10A:
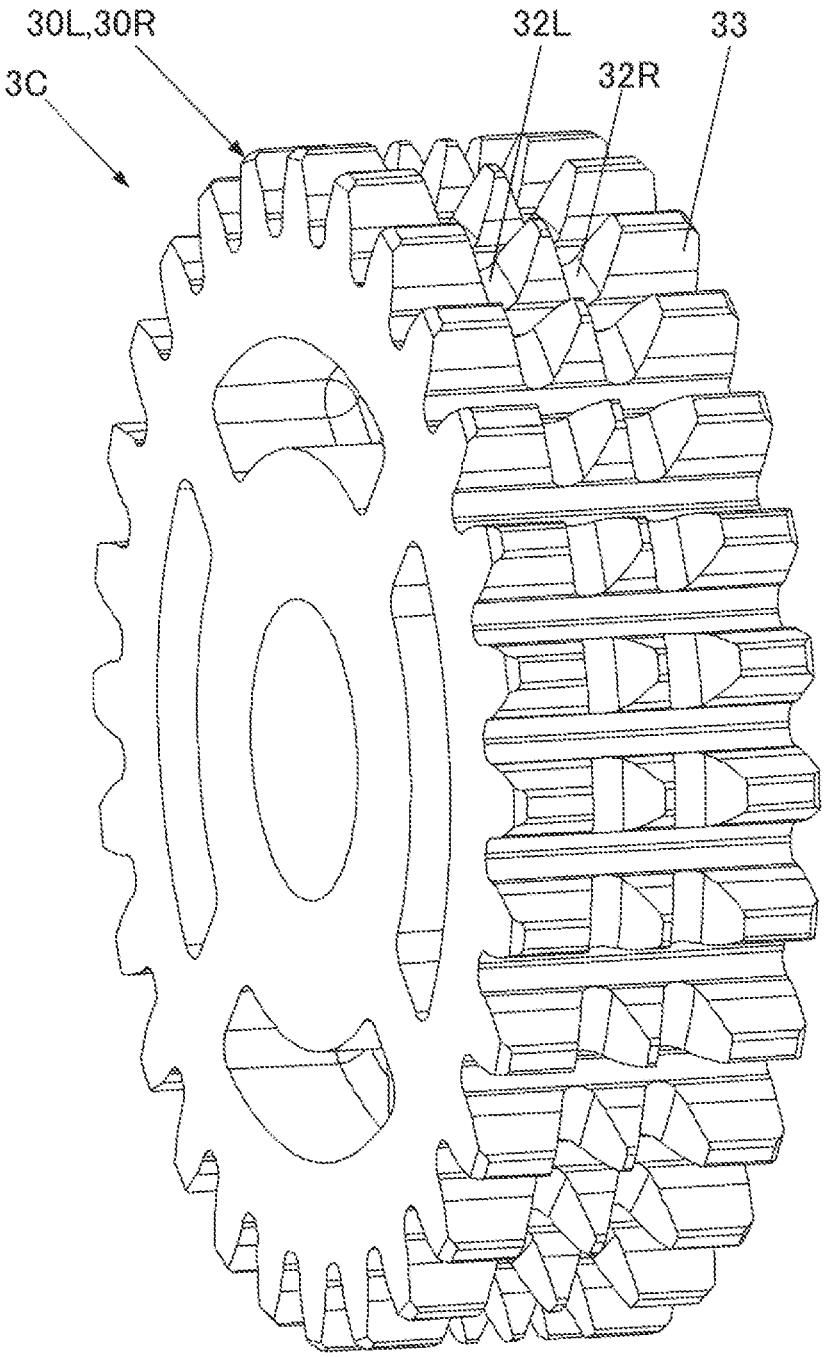
FIG. 10A is a perspective view which shows an example of a main part configuration of a reinforcing bar binding machine according to a third embodiment.
Figure 10B:
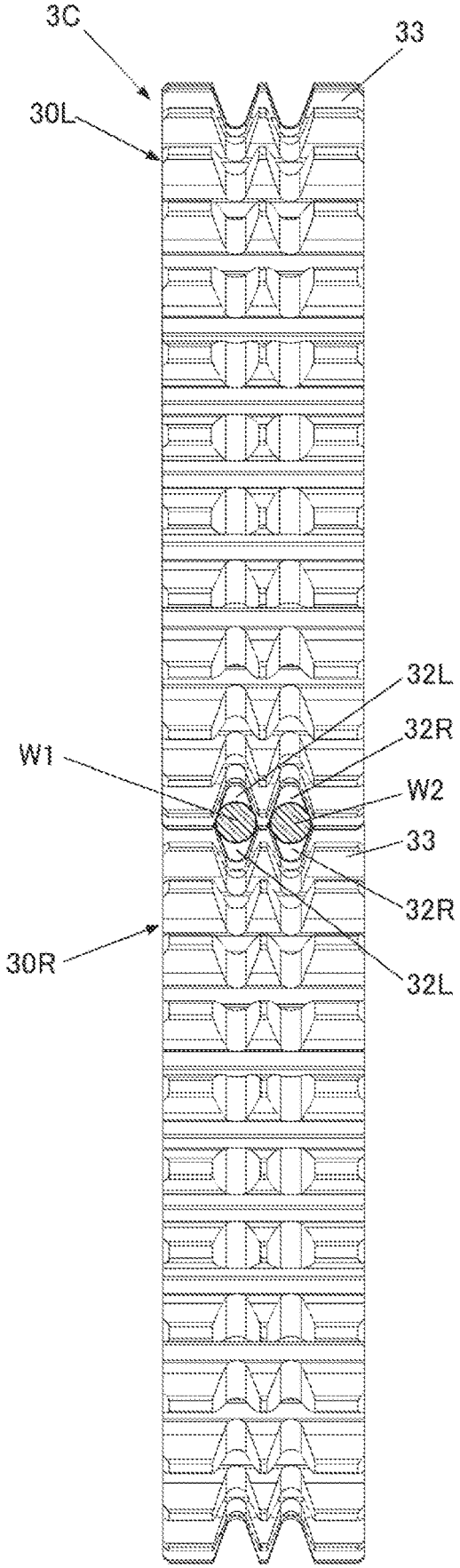
FIG. 10B is a plan view which shows the example of the main part configuration of the reinforcing bar binding machine according to the third embodiment.

Configuration Example of Reinforcing Bar Binding Machine According to Third Embodiment FIG. 10A is a perspective view which shows an example of a main part configuration of a reinforcing bar binding machine according to a third embodiment, and FIG. 10B is a plan view which shows the example of the main part configuration of the reinforcing bar binding machine according to the third embodiment. An overall configuration of the reinforcing bar binding machine according to the third embodiment is equivalent to that of the reinforcing bar binding machine 1A according to the first embodiment.

The reinforcing bar binding machine according to the third embodiment includes a wire feeding portion 3C including, in the pair of feeding gears 30 (30L and 30R), two grooves 32L and 32R arranged in the radial direction of the looped feeding path Ru of the wire W formed by the curl forming portion 5A shown in FIG. 1A and the like.

In the wire feeding portion 3C, the feeding gear 30L and the feeding gear 30R are arranged in parallel along the axial direction of the looped feeding path Ru as in FIG. 1A and FIG. 1B. In the wire feeding portion 3C, a rotational operation of the one feeding gear 30L is transmitted to the other feeding gear 30R by meshing of gear portions 33 provided on outer peripheries of the feeding gear 30L and the feeding gear 30R.

The feeding gear 30L and the feeding gear 30R are oriented to intersect a spur-gear shaped gear portion 33, and the two grooves 32L and 32R are provided parallel to each other along a circumferential direction. The feeding gear 30L and the feeding gear 30R sandwich the one wire W1 in the groove 32L and the other wire W2 in the groove 32R, thereby feeding the two wires W1 and W2 while being arranged in the radial direction.

The wire feeding portion 3C sandwiches the two wires W1 and W2 between the grooves 32L and 32R of the pair of feeding gears 30L and 30R. Accordingly, the wire feeding portion 3C sandwiches the two wires W1 and W2 by the pair of feeding gears 30L and 30R such that the two wires W1 and W2 intersect a direction where the pair of feeding gears 30L and 30R are arranged, and are oriented along the radial direction of the looped feeding path Ru. Therefore, the two wires W1 and W2 are arranged in parallel along the radial direction of the looped feeding path Ru. Accordingly, by the rotation of the pair of feeding gears 30L and 30R, the wire feeding portion 3C feeds, in the orientation along the radial direction of the looped feeding path Ru and along the extending direction of the wires W1 and W2, the two wires W1 and W2 sandwiched between the pair of feeding gears 30L and 30R due to a frictional force generated among the one feeding gear 30L, the other feeding gear 30R and the one wire W1, and a frictional force generated among the one feeding gear 30L, the other feeding gear 30R, and the other wire W2.

In the present disclosure, a plurality of wires fed by a wire feeding portion pass through a curl guide while being arranged in parallel in a radial direction of a looped feeding path, so that even if a diameter of the looped feeding path is increased, the plurality of wires can be fed from the curl guide to enter the leading guide. Accordingly, there is no need to increase a size of a leading guide, and it is possible to suppress an increase in a size and a weight of a binding machine, thereby reducing deterioration in operability.

What is claimed is:

1. A binding machine, comprising:

a pair of feed gears configured to feed a plurality of wires;

a curl forming portion comprising a curl guide and a leading guide, the curl forming portion configured to constitute a looped feeding path for winding the plurality of wires fed by the pair of feed gears around a binding object; and a binding portion comprising a wire locking body and a sleeve, the binding portion configured to twist the plurality of wires wound around the binding object, wherein the curl guide is configured to curl the plurality of wires fed by the pair of feed gears, the leading guide is configured to lead the plurality of wires curled by the curl guide to the binding portion, the curl guide includes:

a first wire guide configured to regulate a position of at least one of the plurality of wires toward an outer peripheral side in a radial direction of the looped feeding path along a circumferential direction of the looped feeding path;

a second wire guide configured to regulate the position of the at least one of the plurality of wires toward one side in an axial direction of the looped feeding path along the circumferential direction, and having a second guide surface protruding inward along the radial direction from the first wire guide;

a third wire guide configured to regulate the position of the at least one of the plurality of wires toward another side in the axial direction along the circumferential direction, and having a third guide surface protruding inward along the radial direction from the first wire guide;

a parallel guide portion provided on a downstream side of the curl guide with respect to a feeding direction of the wires; and a parallel orientation leading portion provided on an upstream side of the curl guide with respect to the feeding direction of the wires, and having a radial dimension larger than that of the parallel guide portion, the parallel orientation leading portion includes a delivery portion provided on an upstream side with respect to the feeding direction of the wires and inclined in the axial direction with respect to the radial direction of the looped feeding path and extending in the feeding direction of the wires, and the curl guide is configured to allow the plurality of wires to pass therethrough while being arranged in the radial direction of the looped feeding path.

2. The binding machine according to claim 1, further comprising:

a magazine configured to accommodate the wires, wherein with respect to a feeding direction of the wires that are fed in a direction where the wires are wound around the binding object, the plurality of wires passing through the curl guide are led so as to be arranged in a radial direction of the looped feeding path on a downstream side of the magazine.

3. The binding machine according to claim 1, wherein the parallel orientation leading portion is configured to lead the plurality of wires passing through the parallel guide portion so as to be oriented to be arranged in a radial direction of the looped feeding path on a downstream side of the pair of feed gears with respect to the feeding direction of the wires that are fed in a direction where the wires are wound around the binding object.

4. The binding machine according to claim 3, wherein the wire locking body is configured to lock the wires, and the parallel orientation leading portion is provided on a downstream side of the wire locking body with respect to the feeding direction of the wires that are fed in the direction where the wires are wound around the binding object.

5. The binding machine according to claim 3, further comprising:

a cutting portion configured to cut the wires wound around the binding object by feeding the wires in a direction opposite to the direction where the wires are wound around the binding object, wherein the parallel orientation leading portion is provided at a downstream side of the cutting portion with respect to the feeding direction of the wires that are fed in the direction where the wires are wound around the binding object, and is configured to lead the plurality of wires such that the wires are oriented to be arranged in the radial direction of the looped feeding path according to orientation of distal ends of the plurality of cut wires.

6. The binding machine according to claim 1, wherein the pair of feed gears is configured to sandwich the plurality of wires such that the wires are oriented to be arranged in the radial direction of the looped feeding path.

7. The binding machine according to claim 1, wherein in the delivery portion, with respect to a first leading portion with which one wire is to be in contact, a second leading portion with which another wire is to be in contact protrudes to an inner peripheral side along the radial direction of the looped feeding path.

8. The binding machine according to claim 3, wherein the parallel orientation leading portion is formed with an introduction and delivery portion over a whole from an upstream side to a downstream side with respect to the feeding direction of the wires, and the introduction and delivery portion is configured by an inclined surface in which, with respect to a first leading portion with which one wire is to be in contact, a second leading portion with which another wire is to be in contact protrudes toward an inner peripheral side along the radial direction of the looped feeding path.

9. The binding machine according to claim 5, wherein the cutting portion is configured to cut the plurality of wires such that, with respect to one wire, a distal end side of another wire is bent in a direction facing an inner peripheral side of the looped feeding path.

10. The binding machine according to claim 5, wherein the cutting portion includes:

an opening;

a first abutting blade portion and a second abutting blade portion provided at an opening end of the opening; and a retraction recess portion configured such that a recess portion recessed from the opening toward the second abutting blade portion is provided.

* * * * *